US006107700A

United States Patent [19]

Ishikawa et al.

[11] Patent Number: 6,107,700

[45] Date of Patent: Aug. 22, 2000

[54] SEMICONDUCTOR DEVICE OF HIERARCHICAL POWER SOURCE STRUCTURE

[75] Inventors: Masatoshi Ishikawa; Tsukasa Ooishi, both of Hyogo, Japan

[73] Assignee: Mitsubishi Denki Kabushiki Kaisha, Tokyo, Japan

[21] Appl. No.: 09/191,121

[22] Filed: Nov. 13, 1998

[30] Foreign Application Priority Data

May 22, 1998 [JP] Japan ..... 10-141541

[51] Int. Cl.[7] ..... G05F 1/10

[52] U.S. Cl. ..... 307/116; 327/544

[58] Field of Search ..... 307/112, 116; 327/544

[56] References Cited

U.S. PATENT DOCUMENTS 5,583,457 12/1996 Horiguchi et al. ..... 327/544
5,724,297 3/1998 Noda et al. ..... 327/544
5,880,604 3/1999 Kawahara et al. ..... 327/544
5,959,927 9/1999 Yamagata et al. ..... 365/229

FOREIGN PATENT DOCUMENTS 6-237164 8/1994 Japan .

*Primary Examiner*—Jeffrey Gaffin
*Assistant Examiner*—Roberto Rios
*Attorney, Agent, or Firm*—McDermott, Will & Emery

[57] ABSTRACT

When an operation of an internal circuit is initiated, a current is supplied from an external power supply node to a sub-power source line for a predetermined period. A semiconductor device having a hierarchical power source structure is provided, which can have a voltage variation in the sub-power source line reduced and which can recover the varied voltage speedily to a predetermined voltage level in an operating state of the internal circuit.

20 Claims, 19 Drawing Sheets

SEMICONDUCTOR DEVICE OF HIERARCHICAL POWER SOURCE STRUCTURE

BACKGROUND OF THE INVENTION

1. Field of the Invention

The present invention relates to a semiconductor device of a hierarchical power source structure having a main power source line and a sub-power source line, and more particularly, to a structure for stabilizing voltage of a sub-power source line.

2. Description of the Background Art

A circuit using CMOS (Complementary MOS) transistors for an integrated circuit is widely known for its low power consumption. A CMOS transistor includes both an N channel MOS transistor (insulated gate type field effect transistor) and a P channel MOS transistor. The current drivability of a CMOS transistor is mainly characterized by the threshold voltage of the MOS transistor, the voltage of the source node, and the voltage applied to the gate. For an N channel MOS transistor, the current drivability is represented by the following equation.

$$Ids=\beta(Vgs-Vth)^2 \quad (1)$$

where Ids indicates the current across the drain and source of an N channel MOS transistor (drain current), Vgs indicates the gate-source voltage of an MOS transistor, Vth indicates the threshold voltage of an N channel MOS transistor, and β is a constant determined by the ratio of the gate length to the gate width of a MOS transistor. The above equation (1) is satisfied under the operating condition of a saturation region. Here, the saturation region is an operating region that satisfies the following relationship.

$$Vds>Vgs-Vth \quad (2)$$

where Vds is the drain-source voltage of an N channel MOS transistor. For a P channel MOS transistor, the saturation region is represented by the same expression with a direction of the drain current reversed.

When the power supply voltage is lowered to reduce the power consumption of an integrated circuit, the internal signal within the integrated circuit becomes smaller in amplitude so that the voltage applied to the gate of the MOS transistor is reduced. As a result, the gate-source voltage Vgs becomes lower. Accordingly, drain current Ids becomes smaller from the above equation (1). The output node cannot be charged/discharged at a high speed. Thus the operating speed of the circuit becomes slower.

In order to increase the operating speed with a low power supply voltage under the condition that the size of the gate (ratio of gate width to gate length) of the MOS transistor is identical, the absolute value of the threshold voltage Vth must be reduced. With a smaller absolute value of threshold voltage Vth, a drain current Ids of a magnitude identical to that when the operating power supply voltage is high can be supplied as represented by equation (1). However, there is a problem that power consumption is increased in a non-operating state (standby state) if the absolute value of threshold voltage Vth is reduced.

A small current flows across the source and drain in an MOS transistor even in a non-operating state (even when the gate voltage is at the ground voltage level and N-MOS transistor is off). This slight current is called "sub-threshold current", and is represented by the following equation.

$$Isub=\alpha\cdot 10^{(Vgs-Vth)/s}:\text{NMOS}$$

$$Isub=\alpha\cdot 10^{(Vth-Vgs)/s}:\text{PMOS}$$

where S is the parameter referred to as the sub-threshold coefficient (sub-threshold voltage swing) indicating the sub-threshold current characteristic, indicating the level of the gate voltage required to vary drain current Ids by one order of magnitude. Therefore, when only the absolute value of threshold voltage Vth is reduced under the condition of Vgs=0 as in a conventional case, sub-threshold current Isub is increased exponentially. For example, when the absolute value of threshold voltage Vth is reduced by 0.1 V under the condition of S=0.1 V, the sub-threshold leakage current increases by a factor of 10. A hierarchical power supply method is known to reduce this sub-threshold leakage current when an MOS transistor is off.

FIG. 36 schematically shows a structure of a conventional hierarchical power supply. Referring to FIG. 36, the hierarchical power supply includes a main power supply line 1102 coupled to a power supply node for transmitting a power supply voltage Vdd, a sub-power supply line 1103 coupled to main power supply line 1102 through a switching transistor 1100, a main ground line 1104 receiving a ground voltage GND, and a sub-ground line 1105 coupled to main ground line 1104 through a switching element 1101. Switching element 1100 is rendered conductive in response to activation (L level: logical low) of a control signal /SW that determines the activation period of the operation of an internal circuit that utilizes the voltages on power supply lines 1102 and 1103 and ground lines 1104 and 1105. Switching element 1101 is rendered conductive in response to an activation (H level: logical high) of a control signal SW.

In this hierarchical power supply structure, the internal circuit has its source connection determined according to the logic level of the output signal in a standby state (when control signals SW and /SW are inactive, and the MOS transistor forming the internal circuit is off).

In FIG. 36, two logic circuits 1107 and 1108 are shown as typical examples of internal circuits. Logic circuit 1107 includes a p channel MOS transistor 1107*a* having a source connected to main power supply line 1102, a gate receiving an input signal IN1, and a drain connected to the output node from which an output signal OUT1 is provided, and an n channel MOS transistor 1107*b* having a source connected to sub-ground line 1105, a gate receiving input signal IN1, and a drain connected to the node from which output signal OUT1 is provided.

Logic circuit 1108 includes a p channel MOS transistor 1108*a* having a source connected to sub-power supply line 1103, a gate receiving an input signal IN2, and a drain connected to a node from which an output signal OUT2 is provided, and an n channel MOS transistor 1108*b* having a source connected to main ground line 1104, a gate receiving input signal IN2, and a drain connected to a node from which output signal OUT2 is provided.

According to this connection, logic circuit 1107 provides an output signal OUT1 of an L level in a standby state. Logic circuit 1108 provides an output signal OUT2 of an H level in a standby state. The operation thereof will now be described briefly.

In an operating mode of logic circuits 1107 and 1108, control signals /SW and SW are rendered active. Switching elements 1100 and 1101 conduct, so that main power supply line 1102 is connected to sub-power supply line 1103, and main ground line 1104 is connected to sub-ground line 1105. Therefore, the voltage on sub-power supply line 1103 becomes equal to the level of voltage Vdd on main power supply line 1102. Also, the voltage on sub-ground line 1105 becomes equal to the level of voltage GND on main ground line 1104. Logic circuits 1107 and 1108 carry out a logic process (negate process) according to input signals IN1 and IN2, respectively, to provide output signals OUT1 and OUT2, respectively. MOS transistors 1107*a*, 1107*b*, 1108*a* and 1108*b* each are a low threshold voltage transistor with the threshold voltage small in absolute value. Operation can be effected at high speed (since the drain current drivability is great) even when power supply voltage Vdd is low.

In a standby state, control signals /SW and SW are inactive. Switching elements 1100 and 1101 do not conduct. Control signal /SW is set to the level of power supply voltage Vdd whereas control signal SW is maintained at the level of the ground voltage. Switching elements 1100 and 1101 are constituted by MOS transistors. The gate-source voltage Vgs is 0 V. Under this state, sub-threshold leakage current flows in each of switching elements 1100 and 1101. Input signals IN1 and IN2 are set to an L level and an H level, respectively. Output signals OUT1 and OUT2 are set at an H level and an L level, respectively.

In logic circuit 1107, the drain-source voltage of MOS transistor 1107*a* attains the level of 0 V, so that leakage current does not flow. In MOS transistor 1107*b*, the gate voltage is at the level of the ground voltage, and the drain voltage attains the level of power supply voltage Vdd. Therefore, sub-threshold leakage current flows. In logic circuit 1108, MOS transistor 1108*b* receives a signal of an H level at its gate. The drain-source voltage is 0 V, so that leakage current does not flow. In contrast, MOS transistor 1108*a* receives a signal of a power supply voltage level at its gate, so that sub-threshold leakage current flows. By making the sub-threshold leakage current of switching element 1100 smaller than the sub-threshold leakage current of MOS transistor 1108*a* in logic circuit 1108 (for example, increase the gate width), the voltage level of sub-power supply line 1103 is reduced. The voltage on the line 1103 is settled at a level in which the sub-threshold leakage current supplied by switching element 1100 is in balance with the sub-threshold leakage current of logic circuit 1108 and other internal circuits not shown. Therefore, the voltage of sub-power supply line 1103 becomes lower than the voltage level of main power supply line 1102.

As for sub-ground line 1105, by setting the gate length, for example, such that the sub-threshold leakage current of switching element 1101 becomes smaller than the total sum of the sub-threshold leakage currents of MOS transistor 1107*b* in logic circuit 1107 and the MOS transistor included in other logic circuits not shown, the voltage level of sub-ground line 1105 is set to a voltage level that provides balance between the sub-threshold leakage current from logic circuit 1107 and other logic circuits not shown and the sub-threshold leakage current discharged through switching element 1101. In this state, the voltage level of sub-ground line 1105 becomes higher than that of ground voltage GND. Therefore, in logic circuit 1107, the source voltage of MOS transistor 1107*b* becomes higher than the gate voltage. The gate-source voltage Vgs attains the level of a negative voltage for the MOS transistor to be reversely biased deeper to reduce the sub-threshold leakage current. In logic circuit 1108, the source voltage of p channel MOS transistor 1108*a* becomes lower than the gate voltage thereof. The gate-source voltage attains a positive level for MOS transistor 1108*a* to be reversely biased deeper. As a result, the sub-threshold leakage current is reduced. It is apparent from the above-described expression of sub-threshold leakage current Isub that the sub-threshold leakage current can be reduced by setting a reverse bias state across the gate and source in comparison to the case where the gate-source voltage Vgs is 0 V.

In logic circuits 1107 and 1108, high speed operation is realized by using a MOS transistor of a low threshold voltage. By changing the voltage level of the sub-power supply line and sub-ground line from the voltage level on the main power supply line and main ground line in the hierarchical power supply structure, the sub-threshold leakage current in a standby state, i.e. the consumed current, can be reduced.

In a standby state as shown in FIG. 37, sub-threshold current Isa supplied from switching element 1100 is set smaller than (equal to when stabilized) sub-threshold leakage current Isb in a standby state of internal circuit 1110 that operates with the voltage on sub-power supply line 1103 used as one operating power supply voltage. When the absolute value of the threshold voltage of switching element 1100 is great and when there are many p channel MOS transistors that flow sub-threshold leakage current in internal circuit 1110, the size of switching element 1100 can be set greater than the size (the ratio of gate width to gate length) of the p channel MOS transistor in internal circuit 1110. However, the ratio of the gate width to the gate length cannot be sufficiently increased (for example, the minimum value of the gate length is limited) since sub-threshold leakage current Isa supplied from switching element 1100 must be set smaller than total sub-threshold leakage current Isb of the entire internal circuit 1110. Therefore, the power consumed by internal circuit 1110 cannot be supplied from main power supply line 1102 to sub-power supply line 1103 at high speed even when switching element 1100 is rendered conductive in a normal operation of internal circuit 1110. The voltage level of sub-power supply line 1103 is reduced, so that internal circuit 1110 cannot operate at high speed.

Even if the ratio of the gate width to the gate length of switching element 1100 is relatively great, the voltage difference between main power supply line 1102 and sub-power supply line 1103 is small. Therefore the drain-source voltage Vds of p channel MOS transistor 1100 is small. Since control signal /SW is driven to the level of the ground voltage when switching element 1100 conducts, switching element 1100 formed of an MOS transistor operates in a non-saturation region. When this drain-source voltage Vds is small, a great drain current cannot be supplied from main power supply line 1102 to sub-power supply line 1103 since the drain voltage is represented by the function of drain-source voltage Vds. There was a problem that reduction in the voltage of sub-power supply line 1103 cannot be compensated for at a high speed. In the transition from a standby state to an operating state, the reduced voltage level of sub-power supply line 1103 can be recovered at high speed to the voltage level of main supply line 1102. Therefore, it is necessary to delay the initiation timing of the operation of internal circuit 1110. Thus, there is a problem that the timing of initiating operation of internal circuit 1110 must be delayed.

When the voltage level of sub-power supply line 1103 is reduced by the operation of internal circuit 1110, the voltage level of sub-power supply line 1103 cannot be recovered at high speed to the original level of power supply voltage Vdd. There is a problem that internal circuit 1110 cannot be operated stably. Particularly, when the voltage level of sub-power supply line 1103 is reduced, the amplitude of the output signal of internal circuit 1110 becomes smaller. The amplitude of the signal applied to the circuit of the next stage becomes smaller, so that the circuit of the next stage cannot be operated at high speed. There is a problem that the operating speed is reduced.

The problem of slow recovery of the voltage drop at sub-power supply line 1103 is also seen in the sub-ground line. In the case of sub-ground line 1105, the voltage level becomes higher than the level of the ground voltage to result in a smaller amplitude of the internal signal. There is a problem that the internal circuit cannot be operated at high speed to charge/discharge the output node.

In a conventional hierarchical power source structure, the main power source line (main power supply line and main ground line) and the sub-power source line (sub-power supply line and sub-ground line) are connected via a switching element. It is therefore difficult to recover the voltage to the original level at high speed during variation of the voltage of the sub-power source line. There is a problem that the internal circuit cannot be operated speedily and stably.

SUMMARY OF THE INVENTION

An object of the present invention is to provide a semiconductor device that can maintain the voltage level of a sub-power source line stably at a predetermined voltage level.

Another object of the present invention is to provide a semiconductor device that can recover a sub-power source line to a constant voltage level at high speed.

A further object of the present invention is to provide a semiconductor device that can recover the voltage level of a sub-power source line to a predetermined voltage level speedily without increasing current consumption.

According to the present invention, when the voltage of a sub-power source line is to be recovered, the voltage level on a main power source line is adjusted or charge is supplied to this sub-power source line from a path different from the main power source line.

By transmitting a voltage having an absolute value greater than that of the voltage on the main power source line to the sub-power source line, the voltage of the sub-power source line can be recovered to the original voltage level speedily during operation of an internal circuit.

Also, by transmitting the charges of the capacitive element to the sub-power source line, variation in the voltage on the sub-power source line can be suppressed. The voltage level on this sub-power source line can be recovered speedily to the original voltage level.

Furthermore, by adjusting the voltage level on the main power source line according to the voltage level on the sub-power source line that transmits a voltage of another logic, the effective voltage (amplitude of the operating power supply voltage) applied to the internal circuit can be set constant to allow stable operation of the internal circuit.

By transmitting the charge of the capacitive element to the main power source line, variation in the voltage level of both the main and sub-power source lines can be suppressed to allow stable operation of the internal circuit.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
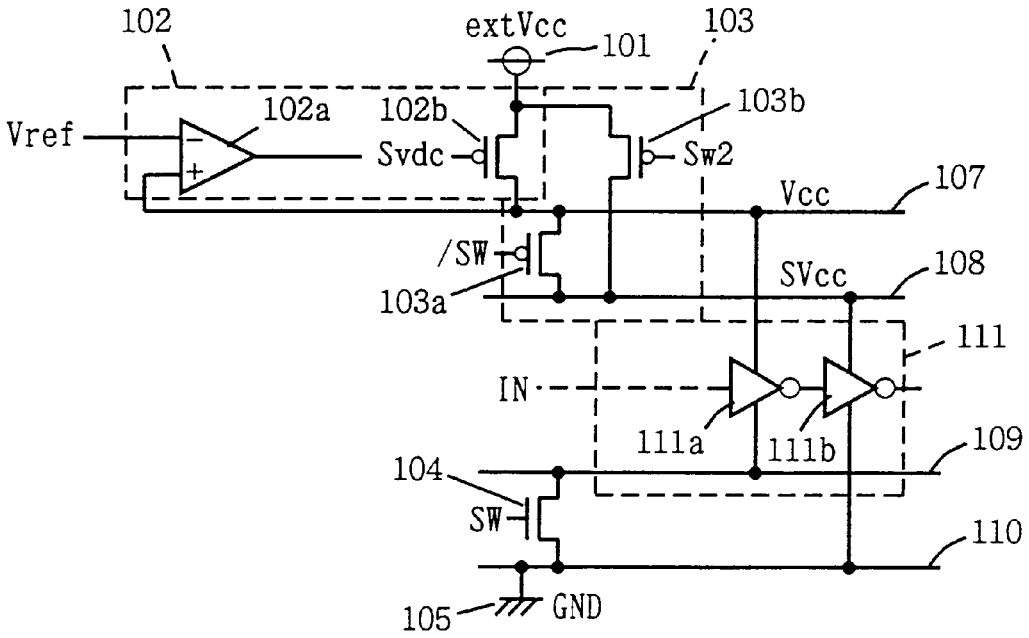
FIG. 1 represents a structure of a semiconductor device according to a first embodiment of the present invention.

FIG. 1 represents a schematic structure of main components of a semiconductor device according to a first embodiment of the present invention. Referring to FIG. 1, a hierarchical power source includes a main power supply line 107 for transmitting a voltage Vcc of a predetermined level, a sub-power supply line 108, a main ground line 110 for transmitting a ground voltage GND to a ground node 105, a sub-ground line 109, and an internal circuit 111 operating with the voltages on power supply lines 10714 110 used as both operating power supply voltages. The term "power source line" represents both "a power supply line" and "a ground line". The term of "power supply line" and "ground line" will be used when a power supply voltage Vcc and a ground voltage GND are to be distinguished.

Internal circuit 111 includes a logic circuit (not circuit) 111*a* operating with voltage Vcc on main power supply line 107 and the voltage on sub-ground line 109 used as both power supply voltages, and a logic circuit (not circuit) 111*b* operating with a voltage Svcc on sub-power supply line 108 and voltage GND on main ground line 110 used as both operating power supply voltages. Internal circuit 111 applies a predetermined logic process on a received internal signal (not shown) for output when control signals SW and /SW are active. In FIG. 1, two stages of inverters included in internal circuit 111 are indicated as typical examples.

An internal voltage-down converter 102 maintaining voltage Vcc on main power supply line 107 at the level of a reference voltage Vref is provided to main power supply line 107. A switch circuit 103 for transmitting an external power supply voltage extVcc that is applied to an external power supply node 101 to sub-power supply line 108 in activation of internal circuit 111 is provided to sub-power supply line 108.

Internal voltage-down converter 102 includes a comparator 102*a* for comparing voltage Vcc on main power supply line 107 and reference voltage Vref, and a drive transistor 102*b* formed of a p channel MOS transistor for supplying a current from external power supply node 101 to main power supply line 107 according to an output signal Svdc of comparator 102*a*.

Switch circuit 103 includes a switching transistor 103*a* formed of a p channel MOS transistor rendered conductive when control signal /SW, which is an operation designating signal for internal circuit 111, is active to electrically connect main power supply line 107 and sub-power supply line 108, and a second switching transistor 103*b* formed of a p channel MOS transistor rendered conductive, in response to a control signal Sw2 attaining an active state for a predetermined period when internal circuit 111 is active, to electrically connect external power supply node 101 to sub-power supply line 108. As in the conventional case, a switching transistor 104 is provided between sub-ground line 109 and main ground line 110. Switching transistor 104 is formed of an n channel MOS transistor rendered conductive in response to activation of control signal SW which is an operation initiation designating signal for internal circuit 111.

Figure 2:
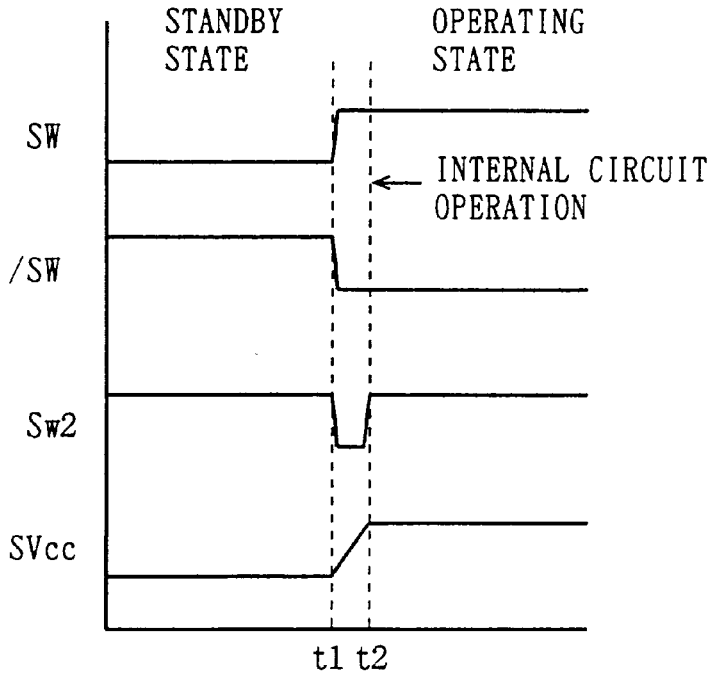
FIG. 2 is a signal waveform diagram representing an operation of the semiconductor device of FIG. 1.

The sum of the sub-threshold currents of the n channel MOS transistors included in logic circuits 111*a* and 111*b* in internal circuit 111 is set greater than the sub-threshold current of switching transistor 104 (under condition of Vgs=0: both become equal when stabilized). The sum of the sub-threshold currents of switching transistors 103*a* and 103*b* is set smaller than the sum of the sub-threshold currents of the p channel MOS transistor included in internal circuit 111 (under the condition of Vgs=0). The MOS transistors that form logic circuits 111*a* and 111*b* in internal circuit 111 each are a low threshold voltage transistor having the absolute value of a threshold voltage thereof set to a small value. The operation of the semiconductor device of FIG. 1 will be described with reference to the signal waveform diagram of FIG. 2.

In a standby state of internal circuit 111, control signal /SW is at an H level (power supply voltage Vcc level) and control signal SW is at a ground voltage GND level. Switching transistors 103*a* and 104 are off. Control signal Sw2 is at an H level of external power supply voltage extVcc, and switching transistor 103*b* is in a nonconductive state. At the present stage, voltage SVcc on sub-power supply line 108 is lower than the level of voltage Vcc on main power supply line 107 due to the sub-threshold current of logic circuits 111*a* and 111*b* in internal circuit 111. Voltage Svcc on sub-power supply line 108 is determined by the sub-threshold current supplied by switching transistor 103*a* and 103*b*, and by the sub-threshold leakage current of the p channel MOS transistors in internal circuit 111 (the voltage level where they balance). Internal voltage-down converter 102 constantly operates even during this standby state to supply current from external power supply node 101 onto main power supply line 107 via drive transistor 102*b* to maintain voltage Vcc on main power supply line 107 at the level of reference voltage Vref.

When internal circuit 111 is activated, control signals SW and /SW are driven to an H level and an L level, respectively, at time t1. In response, switching transistors 103*a* and 104 conduct. Main power supply line 107 is electrically connected to sub-power supply line 108 via switching transistor 103*a*. Main ground line 110 is electrically connected to sub-ground line 109 via switching transistor 104. The voltage difference Vcc-SVcc between main and sub-power supply lines 107 and 108 is small, so that switching transistor 103*a* operates in a non-saturation region. Therefore, the drain current becomes smaller. The drain current of a p channel MOS transistor in the non-saturation region is represented by the following equation.

$$Ids=-\beta((Vgs-Vth)Vds-Vds^2/2)$$

The sign "−" indicates the flow of current from the source towards drain in a p channel MOS transistor. Here, Vth indicates the threshold voltage of a p channel MOS transistor.

Similarly, switching transistor 103*b* responds to activation of control signal Sw2 to conduct during the period of time t1 to time t2. The current from external power supply node 101 is supplied to sub-power supply line 108. In switching transistor 103, the drain-source voltage Vds is relatively large. Therefore, a relatively large drain current flows from external power supply node 101 towards sub-power supply line 108, whereby voltage SVcc on sub-power supply line 108 rises at a high speed. Therefore, even when the ratio of the gate width to the gate length of each of switching transistors 103*a* and 103*b* is limited for restricting the sub-threshold current of switching transistors 103*a* and

103*b*, current can be supplied speedily from external power supply node 101 to sub-power supply line 108 through switching transistor 103*b*. Therefore, voltage SVcc on sub-power supply line 108 can be recovered speedily to the level of a predetermined voltage Vcc in operation of internal circuit 111.

Sub-ground line 109 is only discharged to the level of ground voltage GND on main ground line 110 via switching transistor 104. When the sub-threshold leakage current flows mainly through the p channel MOS transistor in internal circuit 111, the power supply voltage on sub-power supply line 108 is recovered to the level of the predetermined internal power supply voltage Vcc by switch circuit 103 to allow internal circuit 111 to operate stably.

At time t2, control signal Sw2 is rendered inactive, and switching transistor 103*b* is rendered non-conductive. In response, sub-power supply line 108 is electrically connected to main power supply line 107 only via switching transistor 103*a*. Therefore, sub-power supply line 108 is maintained at the level of voltage Vcc on main power supply line 107.

From time t2 onward, the voltages on sub-power supply line 108 and sub-ground line 109 keep a constant voltage level in a stable manner, whereby internal circuit 111 operates stably. When internal circuit 111 operates under this state, it may be considered that the level of voltage SVcc is reduced due to consumption of the current on sub-power supply line 108. However, by rendering control signal Sw2 applied to switching transistor 103*b* active for a predetermined time according to change in the input signal to internal circuit 111, reduction of voltage SVcc on sub-power supply line 108 in an operating state (active cycle) can be suppressed.

Figure 3:
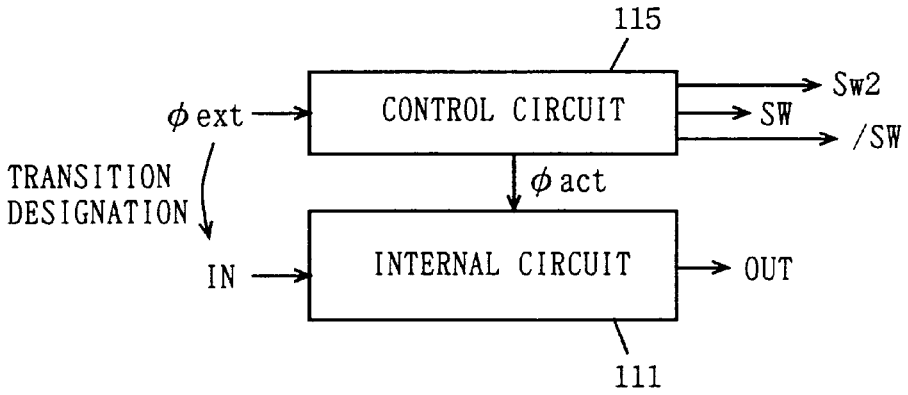
FIG. 3 represents a schematic structure of a control signal generation unit of FIG. 1.

FIG. 3 schematically represents a structure of a control signal generation unit. Referring to FIG. 3, the control signal generation unit includes a control circuit 115 for generating control signals SW, /SW and Sw2 according to an externally applied internal circuit operation initiation designating signal ϕext. Control circuit 115 responds to signal ϕext to generate a signal ϕact that controls activation of an input signal IN applied to internal circuit 111. When activation control signal ϕact from control circuit 115 is active, input signal IN applied to internal circuit 111 is changed according to the level of an externally applied signal or an internally generated signal. A specific structure of internal circuit 111 will be described later. When in a dynamic random access memory, for example, a RAS related circuit that enters an operable state in response to activation of an externally applied row address strobe signal /RAS to carry out an operation related to the row select operation of a memory cell is provided. Alternatively, a CAS related circuit actuated in response to activation of an externally applied column address strobe signal /CAS to carry out an operation related to the column select operation of a memory cell, and a circuit that carries out data writing/reading is provided. In these circuits, row address strobe signal /RAS and column address strobe signal /CAS are received as externally applied operation initiation designating signal ϕext. In the case of a synchronous DRAM that operates in synchronization with an externally and repeatedly applied clock signal, the externally applied operation initiation designating signal takes the form of a command (a combination of the logic states of a plurality of control signals).

In a portable terminal such as a PDA (Personal Digital Assistant), the externally applied operation initiation designating signal ϕext is rendered active when communication is initiated in response to a call from a calling party or in a calling mode for calling a destination party. In this case, internal circuit 111 is a circuit (CODEC) processing a desired data or audio signal.

Thus, the structure of internal circuit 111 is appropriately determined according to the structure of the circuit device in which the hierarchical power source structure is employed.

Figure 4:
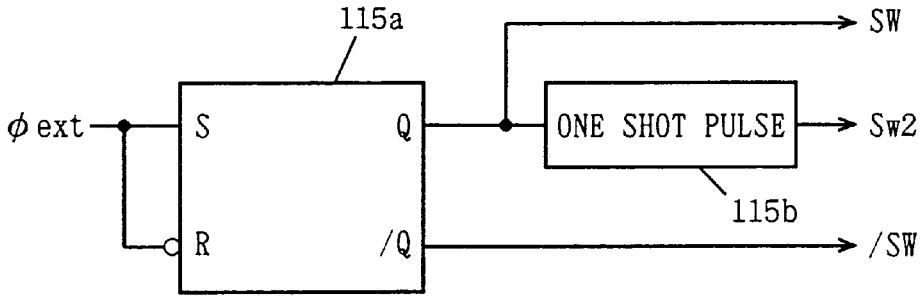
FIG. 4 represents a schematic structure of a control circuit of FIG. 3.

FIG. 4 shows an example of a structure of control circuit 115 of FIG. 3. Referring to FIG. 4, control circuit 115 includes a set/reset flip-flop 115*a* set in response to activation of an externally applied operation initiation designating signal ϕext and reset in response to inactivation of externally applied operation initiation designating signal ϕext, and a one shot pulse generation circuit 115*a* for generating a one shot pulse signal in response to the rise of a signal from output Q of set/reset flip-flop 115*a*. Set/reset flip-flop 115*a* provides control signal SW from output Q and control signal /SW from complementary output /Q. One shot pulse generation circuit 115*b* is formed of a well-known circuit. One shot pulse generation circuit 115*b* generates a signal that is pulled down to an L level for a predetermined time in response to a rise of control signal SW to output the generated signal as control signal Sw2.

When externally applied operation initiation designating signal ϕext is rendered active in the structure of control signal generated 115 of FIG. 4, set/reset flip-flop 115*a* is set. Control signal SW from output Q is rendered active to be driven to an H level. Here, complementary control signal /SW is pulled down to an L level. One shot pulse generation circuit 115*b* provides control signal Sw2 in the form of a one shot pulse signal that attains an L level for a predetermined time in response to a rise of control signal SW.

When external operation initiation designating signal ϕext is rendered inactive to designate completion of the operation of internal circuit 111, set/reset flip-flop 115*a* is reset. Control signal /SW from output /Q is pulled up to an H level whereas control signal SW from output Q is pulled down to an L level. Therefore, switching transistors 103*a* and 104 shown in FIG. 1 are rendered nonconductive in a standby state. Control signal Sw2 makes no transition.

Figure 5:
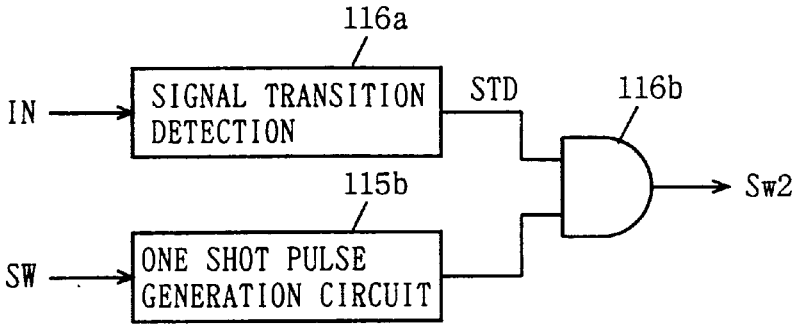
FIG. 5 represents a schematic structure of a modification of the control circuit of FIG. 3.

FIG. 5 schematically shows a structure of a modification of the control signal generation circuit. FIG. 5 represents a structure of a control signal generation unit for control signal Sw2. Referring to FIG. 5, the control signal generation circuit includes a signal transition detection circuit 116*a* for detecting transition of input signal IN, and an AND circuit 116*b* for receiving an output signal of one shot pulse generation circuit 115*b* and an output signal STD of signal transition detection circuit 116a. Control signal Sw2 is output from AND circuit 116*b*.

According to the structure of FIG. 5, control signal Sw2 is rendered active for every detection of transition of input signal IN by signal transition detection circuit 116*a*. When input signal IN changes and internal circuit 111 consumes the current on sub-power supply line 108 in an operation mode of internal circuit 111 (refer to FIG. 3), control signal Sw2 is rendered active, whereby switching transistor 103*b* supplies current from external power supply node 101 to sub-power supply line 108. Accordingly, reduction in voltage SVcc on sub-power supply line 108 can be suppressed to allow a stable and speedy operation of internal circuit 111.

[Modification]

Figure 6:
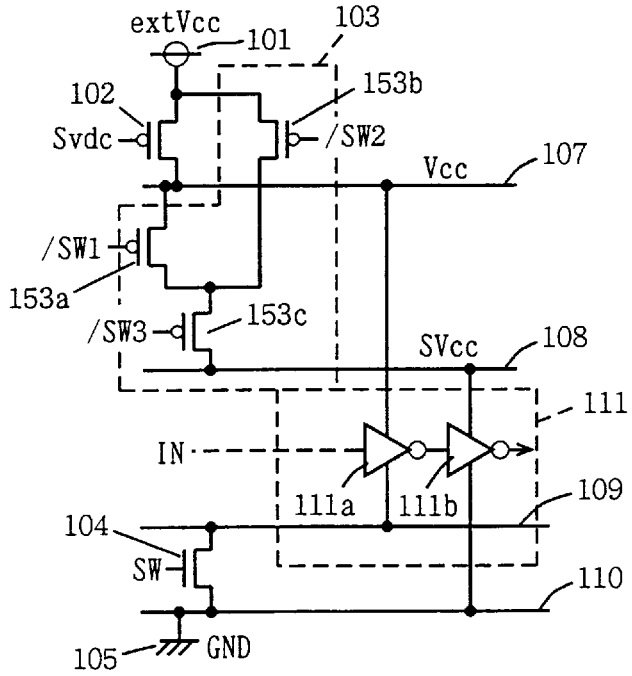
FIG. 6 represents a structure of a modification of the first embodiment of the present invention.

FIG. 6 shows a modification of a semiconductor device of the first embodiment of the present invention. The structure of FIG. 6 compensates for reduction in voltage on sub-power supply line 108 when internal circuit 111 operates, different from the switch circuit 103 of FIG. 1. The remaining structure is identical to that of FIG. 1. In the semiconductor device of FIG. 6, components corresponding to those of FIG. 1 have the same reference characters allotted.

Figure 7:
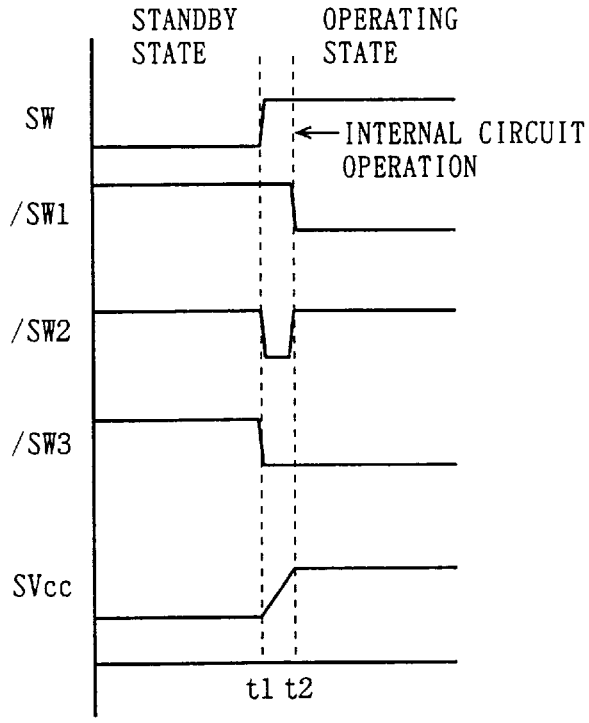
FIG. 7 is a signal waveform diagram representing an operation of the semiconductor device of FIG. 6.

Referring to FIG. 6, switch circuit 103 includes a first switching transistor 153*a* formed of a p channel MOS transistor rendered conductive in response to activation of a control signal /SW1 to transmit voltage Vcc on main power supply line 107, a second switching transistor 153*b* formed of a p channel MOS transistor rendered conductive in response to activation of a control signal /SW2 to transmit the voltage on external power supply node 101, a third switching transistor 153c connected between switching transistors 153*a* and 153*b* and sub-power supply line 108, and formed of a p channel MOS transistor rendered conductive in response to activation of a control signal /SW3 for electrically connecting switching transistors 153*a* and 153*b* to sub-power supply line 108. The operation of the semiconductor device of FIG. 6 will be described with reference to the signal waveform diagram of FIG. 7.

When internal circuit 111 is in a standby state, control signal SW is at an L level, and control signals /SW1, /SW2 and /SW3 are at an H level. In this state, switching transistors 104, 153*a*, 153*b* and 153*c* are in a nonconductive state. Therefore, sub-threshold current flows through switching transistors 153*a* and 104. The level of voltage SVcc on sub-power supply line 108 is determined by the sub-threshold current of switching transistor 153*c* and the sub-threshold current of the p channel MOS transistor in internal circuit 111. Voltage SVcc on sub-power supply line 108 becomes lower than voltage Vcc on main power supply line 107.

When input signal IN applied to internal circuit 111 makes a transition, the operation initiation designating signal to internal circuit 111 is rendered active. At time t1, control signal SW is driven to an H level, and control signal /SW3 is driven to an L level. Control signal /SW2 is driven to an active state of an L level during the period from time t1 to time t2. In response, switching transistors 153*b* and 153*c* in switch circuit 103 conduct, whereby external power supply node 101 is electrically connected to sub-power supply line 108. Therefore, voltage SVcc on sub-power supply line 108 rises speedily. Although current flows towards sub-power supply line 108 via the two switching transistors 153*b* and 153*c*, switching transistor 153*b* has its source node connected to external power supply node 101, and the voltage at its drain node attains the level of voltage Vcc on main power supply line 108. The drain-source voltage of switching transistor 153*b* is greater than the drain-source voltage of switching transistor 153*c*. Therefore, a relatively large current is transmitted to switching transistor 153*c* via switching transistor 153*b*.

In response to the current from switching transistor 153*b*, the voltage at the source node of switching transistor 153*c* rises. The difference in the source-drain voltage of switching transistor 153 becomes greater, so that switching transistor 153*c* supplies current at a high speed to sub-power supply line 108. Therefore, even if the ratio of the gate width to the gate length of switching transistor 153*c* is limited for restricting the sub-threshold current in a standby state, the drain-source voltage difference of switching transistor 153*c* can be increased. Therefore, switching transistor 153*c* can transmit a relatively large current to sub-power supply line 108 upon transition of the operation state. Voltage SVcc on sub-power supply line 108 can be driven speedily to a predetermined voltage level.

At time t2, control signal /SW2 is driven to an H level, and control signal /SW1 is pulled down to an L level from an H level. Switching transistor 153*a* conducts to supply current from main power supply line 107 to sub-power supply line 108. This prevents voltage SVcc on sub-power supply line 108 from rising to the level of external power supply voltage extVcc. Voltage SVcc on sub-power supply line 108 is maintained at the level of voltage Vcc on main power supply line 107. At time t2 onward, internal circuit 111 operates according to input signal IN.

According to the structure of the switch circuit shown in FIG. 6, the sub-threshold current with respect to sub-power supply line 108 in a standby state is determined by the size (ratio of gate width to gate length) of switching transistor 153*c*. When the current drivability of switching transistor 153*b* is set to a relatively high level, a relatively large current is supplied to the source of switching transistor 153*c* upon transition from this standby state to an operating state. Therefore, the drain-source voltage difference of switching transistor 153*c* can be increased, so that sub-power supply line 108 is charged with a greater current drivability. In a standby state, the sub-threshold current can be set by switching transistor 153*c*. The voltage level of sub-power supply line 108 can be set to a predetermined voltage level. In this case, limitation on the current drivability of switching transistors 153*a* and 153*b* is alleviated to simplify the designing of the circuit.

Figure 8:
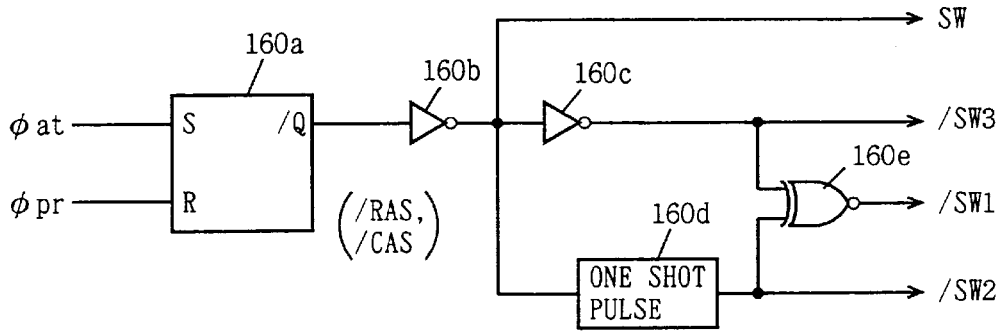
FIG. 8 represents a schematic structure of the component generating the control signal of FIG. 6.

FIG. 8 schematically shows a structure of this modified control signal generation unit. Referring to FIG. 8, the control signal generation unit includes a set/reset flip-flop 160*a* that is set in response to activation of an externally applied internal circuit operation initiation designating signal ϕat and reset in response to activation of an externally applied internal circuit operation end designating signal ϕpr, an inverter 160*b* for inverting an output signal from output /Q of set/reset flip-flop 160*a* for generating a control signal SW, an inverter 160*c* inverting control signal SW from inverter 160*b* to generate a control signal /SW3, a one shot pulse generation circuit 160*d* for generating a one-shot pulse signal that is pulled down to an L level for a constant time in response to a rise of control signal SW from inverter 160*b*, and a match detection circuit 160*e* for detecting match/mismatch of the logics of control signal /SW3 from inverter 160*c* and control signal /SW2 from one shot pulse generation circuit 160*d*. Control signal /SW1 is output from match detection circuit 160*e*.

According to the structure of FIG. 8, in an operating mode of internal circuit 111, internal circuit operation initiation designating signal ϕat is rendered active to set flip-flop 160*a*, which in turn has the signal from output Q pulled down to an L level. In response, control signal SW from inverter 160*b* is pulled up to an H level and control signal ϕSW3 from inverter 160*c* is pulled down to an L level. Control signal /SW2 from one shot pulse generation circuit 160*d* is pulled down to an L level for a predetermined time. In response to the drive of control signal /SW2 to an H level, control signal /SW1 from match detection circuit 160*e* is driven to an L level.

In a standby state, control signals /SW3 and /SW2 both attain an H level, and control signal /SW1 from match detection circuit 160*e* attains an H level. The usage of match detection circuit 160*e* allows control signal ϕSW1 to be driven to an active state of an L level only when the logic levels of control signals /SW3 and /SW2 differ.

At completion of the operation of internal circuit 111, externally applied internal circuit operation end designating signal ϕpr attains an active state to reset set/reset flip-flop 160*a*, which in turn has the signal from output /Q pulled up to an H level to drive control signal SW to an L level. Also, control signal /SW3 from inverter 160*c* is driven to an H level. In response, control signal /SW1 from match detection circuit 160*e* is driven to an H level again to attain a standby state.

According to the structure of FIG. 8, the internal circuit operation mode is designated in the form of a command used in, for example, a synchronous DRAM. Alternatively, as indicated by the parenthesis in FIG. 8, external row address strobe signal /RAS or column address strobe signal /CAS may be applied as an internal circuit operation initiation designating signal and internal circuit operation end designating signal as in a general DRAM. In this case, set/reset flip-flop 160*a* is not needed. Row address strobe signal /RAS or column address strobe signal /CAS is applied to inverter 160*b*.

According to the first embodiment of the present invention, the external power supply node is electrically connected to the sub-power supply line for a predetermined period at the initiation of an operation of an internal circuit that uses the voltage on the sub-power supply line as one operating power supply voltage. Therefore, the voltage on the sub-power supply line can be driven to a predetermined voltage level at a high speed. By implementing a structure in which the external power supply node and the sub-power supply line are electrically connected according to transition of an input signal during the operation mode of the internal circuit, current can be supplied to the sub-power supply line according to the operation of the internal circuit. Therefore, reduction in the voltage on the sub-power supply line can be suppressed.

According to the structure shown in FIGS. 1 and 6, the external power supply node is electrically connected to the sub-power supply line. Alternatively, the node that supplies a voltage lower than ground voltage GND may be electrically connected to the sub-ground line for a predetermined time in the operation mode of the internal circuit. In this case, the voltage level of the sub-ground line can be driven to the ground voltage level speedily. For this structure with respect to the sub-ground line, an n channel MOS transistor is used instead of the p channel MOS transistor in switch circuit 103.

According to the structure of FIG. 8, control signal /SW1 is rendered active for a predetermined time (refer to FIG. 5) in response to transition of input signal IN. Alternatively, the node from which an internal high voltage Vpp is supplied, not the external power supply node, may be connected to the sub-power supply line.

Second Embodiment

Figure 9:
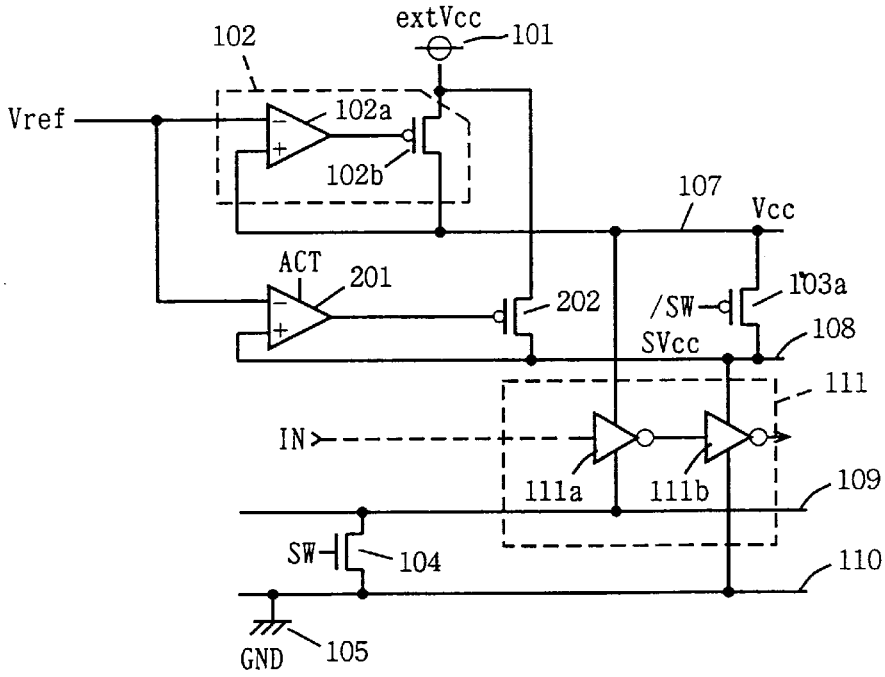
FIG. 9 represents a structure of a semiconductor device according to a second embodiment of the present invention.

FIG. 9 shows the main portion of a semiconductor device according to a second embodiment of the present invention. Referring to FIG. 9, there are provided a comparator 201 rendered active during activation of activation signal ACT of internal circuit 111 to compare reference voltage Vref with the voltage on sub-power supply line 108, and a drive transistor 202 formed of a p channel MOS transistor for supplying current from external power supply node 101 to sub-power supply line 108 according to an output signal of comparator 201. As a switch circuit, a switching transistor 103*a* is provided between main power supply line 107 and sub-power supply line 108. Switching transistor 103*a* is rendered conductive in response to activation of control signal /SW. The remaining structure is identical to that of FIG. 1. Corresponding components have the same reference characters allotted, and detailed description thereof will not be repeated.

Figure 10:
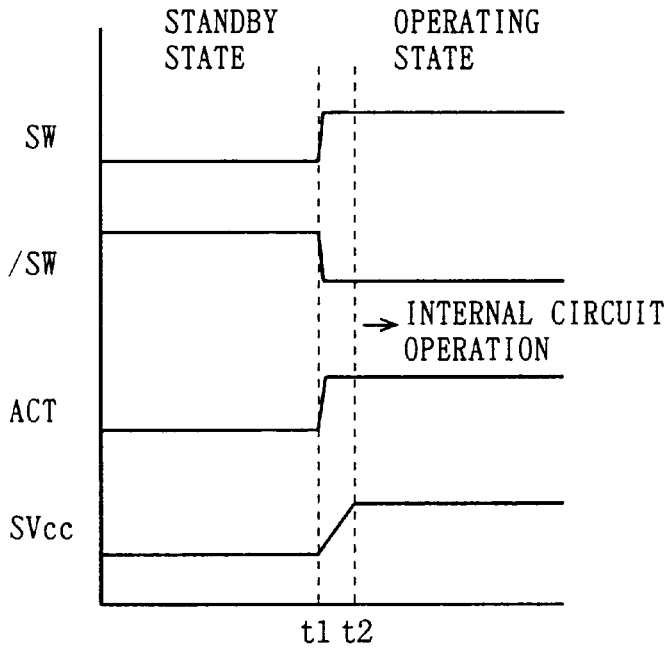
FIG. 10 is a signal waveform diagram representing an operation of the semiconductor device of FIG. 9.

The sub-threshold leakage current of drive transistor 202 and switching transistor 103*a* at Vgs=0 is set smaller than the sum of the sub-threshold leakage current of internal circuit 111 at Vgs=0. The operation of the semiconductor device of FIG. 9 will be described with reference to the signal waveform diagram of FIG. 10.

In a standby state, control signals SW and /SW and activation signal ACT are at an inactive state. Switching transistors 103*a* and 104 are in a nonconductive state. Comparator 201 is in an inactive state. Comparator 201 does not carry out a comparison operation when in an inactive state, and provides a signal of an H level corresponding to external power supply voltage extVcc to maintain drive transistor 202 at a nonconductive state. In this state, sub-threshold leakage current flows to sub-power supply line 108 via transistors 202 and 103. Voltage SVcc on sub-power supply line 108 is maintained at a level balancing the sub-threshold currents supplied from transistors 202 and 103*a* with each other. Switching transistor 104 discharges the current from sub-ground line 109 to ground node 105 via main ground line 105. In this case, the sub-threshold current of switching transistor 104 at Vgs=0 is smaller than the sub-threshold current of internal circuit 111 at Vgs=0. Therefore, the voltage level on sub-ground line 109 becomes higher than the level of the ground voltage.

When internal circuit 111 operates, control signals SW and /SW are rendered active, and activation signal ACT is also driven to an active state at time t1. In response, switching transistors 103*a* and 104 are both rendered conductive, whereby main power supply line 107 is electrically connected to sub-power supply line 108 and main ground line 110 is electrically connected to sub-ground line 109. Here, the difference in voltage level between voltage Vcc on main power supply line 107 and voltage SVcc on sub-power supply line 108 is small. Therefore, the supplied amount of current by switching transistor 103*a* is small. Comparator 201 is activated in response to activation of signal ACT to compare voltage SVcc on sub-power supply line 108 with reference voltage Vref. Reference voltage Vref determines the voltage level of voltage Vcc on main power supply line 107 (voltage-down converter 102 sets power supply voltage Vcc to the level of reference voltage Vref.) In this state, the output signal of comparator 201 attains a low level. The conductance of drive transistor 202 becomes smaller. Current is supplied from external power supply node 101 to sub-power supply line 108. The source of drive transistor 202 receives external power supply voltage ext.Vcc. A drain current greater than that of switching transistor 103*a* is provided to sub-power supply line 108. Therefore, voltage SVcc on sub-power supply line 108 rises speedily to arrive at the level of internal power supply voltage Vcc.

When voltage SVcc on sub-power supply line 108 is stabilized at time t2, internal circuit 111 attains an active state to carry out a predetermined operation according to input signal IN.

When internal circuit 111 operates according to input signal IN so that voltage SVcc on sub-power supply line 108 is consumed, drive transistor 202 supplies current from external power supply node 101 to sub-power supply line 108 according to the comparison operation of comparator 201. Therefore, reduction of voltage SVcc on sub-power supply line 108 can be suppressed during operation of internal circuit 111. In contrast to the structure where current is supplied from main power supply line 107 via switching transistor 103*a*, recovery of the voltage on sub-power supply line 108 to a predetermined voltage level in an operating state is effected more speedily.

According to the structure shown in FIG. 9, an internal voltage-down converter 102 that operates constantly is provided to main power supply line 107. An internal voltage-down converter that has a structure similar to that including comparator circuit 201 and drive transistor 202 and activated at the time of operation of internal circuit 111 is provided to main power supply line 107. In this case, reduction of voltage Vcc on main power supply line 107 can be prevented when the logic circuit in internal circuit 111 consumes the voltage on main power supply line 107. Accordingly, reduction of the voltage level of voltage SVcc on sub-power supply line 108 can be suppressed. This is because internal voltage-down converter 102 that constantly operates has its current drivability set relatively small to reduce current consumption in a standby state (including only the function to prevent reduction of power supply voltage Vcc due to leakage current in a standby state).

Activation signal ACT may be a signal identical to control signal SW. Since activation signal ACT is only required to be activated during operation of internal circuit 111, an internal control signal such as a row address strobe signal /RAS or a column address strobe signal /CAS may be used.

According to the second embodiment of the present invention, a current is supplied from an external power supply node to a sub-power supply line according to an output signal of a comparator that compares the voltage on the sub-power supply line with a reference voltage. Therefore, reduction in the voltage on the sub-power supply line during operation of the internal circuit can be reduced. Also, the recovery to the original voltage level can be effected speedily to allow stable operation of the internal circuit.

Third Embodiment

Figure 11:
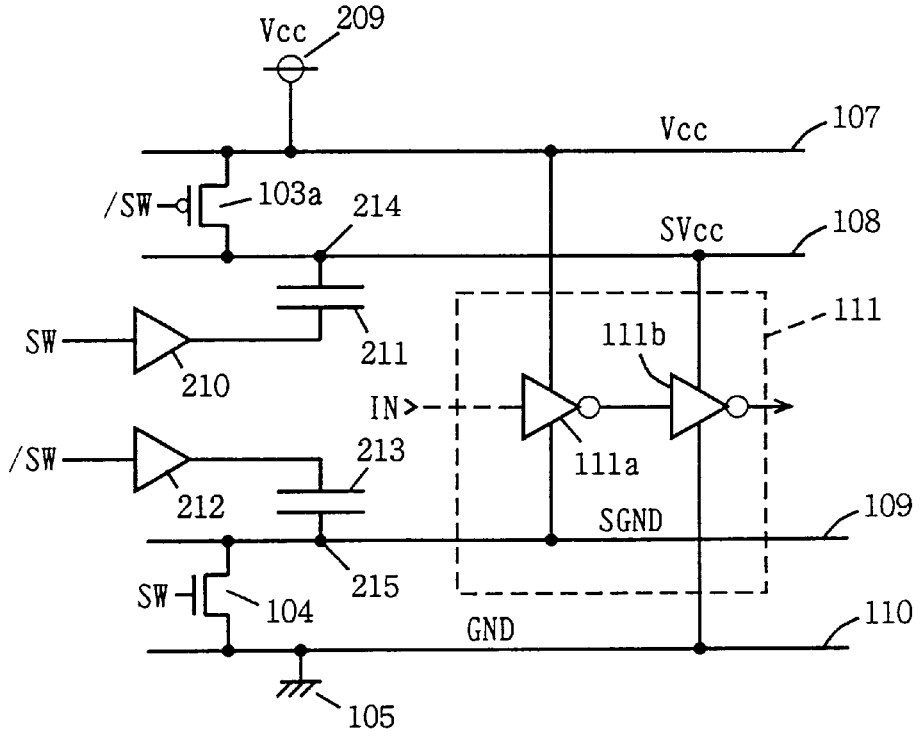
FIG. 11 represents a structure of a semiconductor device according to a third embodiment of the present invention.

FIG. 11 shows a structure of a semiconductor device according to a third embodiment of the present invention. Referring to FIG. 11, main power supply line 107 is connected to a power supply node 209. Power supply node 209 may be an external power supply node, or an output node of an internal voltage-down converter. Switching transistor 103*a* formed of a p channel MOS transistor is connected between main power supply line 107 and sub-power supply line 108, and is rendered conductive in response to activation of control signal /SW. Switching transistor 104 formed of an n channel MOS transistor is provided between main ground line 110 and sub-ground line 109, and is rendered conductive in response to activation of control signal SW. Control signals SW and /SW are driven to an active state at an operation mode of internal circuit 111.

In the structure of FIG. 11, there are further provided a driver 210 receiving control signal SW, a capacitor 211 for supplying charges to sub-power supply line 108 via an electrode node 214 according to an output signal of driver 210, a driver 212 receiving control signal /SW, and a capacitor 213 for drawing out charges from sub-ground line 109 via an electrode node 215 according to an output signal of driver 212. Drivers 210 and 212 have a relatively great current drivability to drive corresponding capacitors 211 and 213 speedily. The operation of the semiconductor device of FIG. 11 will now be described with reference to the signal waveform diagram of FIG. 12.

In the standby state, control signals SW and /SW are inactive, and switching transistors 103*a* and 104 are nonconductive. In this state, driver 210 provides an output signal of an L level, and driver 212 provides a signal of an H level. Electrode nodes 214 and 215 of capacitors 211 and 213 are charged to the levels of voltage SVcc on sub-power supply line 108 and voltage SGND on sub-ground line 109, respectively. The voltage level of sub-power supply line 108 is determined by the sub-threshold currents of switching transistor 103*a* and internal circuit 111. The voltage level of sub-power supply line 108 becomes lower than the level of voltage Vcc on main power supply line 107. Voltage SGND on sub-ground line 109 has its level determined by the sub-threshold currents of internal circuit 111 and switching transistor 109 to become higher than the level of ground voltage GND on main ground line 110.

Figure 12:
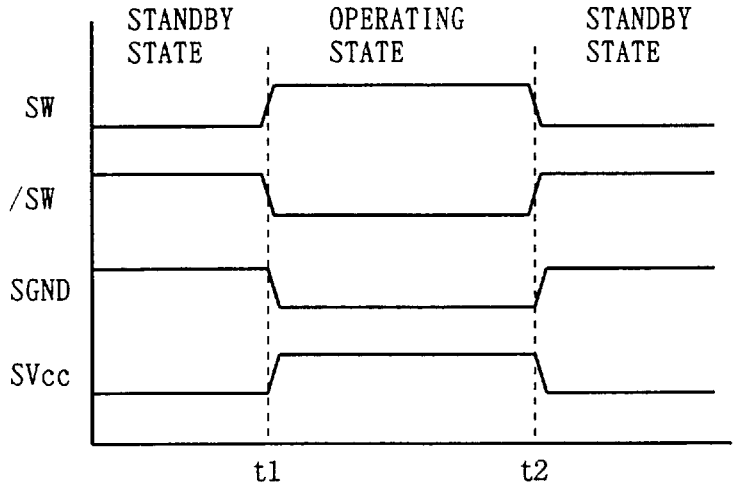
FIG. 12 is a signal waveform diagram representing an operation of the semiconductor device of FIG. 11.

When internal circuit 111 operates, control signals SW and /SW are activated at time t1 of FIG. 12. Switching transistors 103*a* and 104 conduct to electrically connect main power supply line 107 to sub-power supply line 108 and sub-ground line 109 to main ground line 110. Here, the output signal of driver 210 is driven to an H level from an L level. The charges in capacitor 211 are supplied onto sub-power supply line 108 via electrode node 214. As a result, voltage SVcc on sub-power supply line 108 rises speedily. In response to the fall of complementary control signal /SW, the output signal of driver 212 is driven to an L level from an H level. Capacitor 213 draws charges from electrode node 215 to reduce the level of voltage SGND on sub-ground line 109 speedily. As a result, the voltage on sub-power supply line 108 and sub-ground line 109 is recovered to the original voltage level at a high speed.

The capacitance values of capacitors 211 and 213 are set appropriately according to the parasitic capacitances connected to sub-power supply line 108 and sub-ground line 109. The effect ΔV of capacitor 211 on the change in the voltage of sub-power supply line 108 is represented by the following equation.

$$\Delta V = Vcc \cdot Ca/(Ca+Cp)$$

where Vcc indicates the amplitude of the output signal of driver 210, Ca indicates the capacitance of capacitor 211, and Cp indicates the capacitance value of the parasitic capacitance of sub-power supply line 108. The degree of effect of capacitor 213 on sub-ground line 109 corresponds to the above equation provided that the sign is altered.

By driving capacitors 211 and 213 according to the output signals of drivers 210 and 212, the voltage on sub-power supply line 108 and sub-ground line 109 can be recovered at a high speed to the original voltage level.

When the operation of internal circuit 111 is completed at time t2, control signals SW and /SW are rendered inactive again. Switching transistors 103*a* and 104 are rendered nonconductive. Here, the output signal from driver 210 is pulled down to an L level from an H level. In response, voltage SVcc on sub-power supply line 108 is reduced by capacitor 211. Similarly, voltage SGND on sub-ground line 109 rises by driver 212 and capacitor 213. Voltages SVcc and SGND on sub-power supply line 108 and sub-ground line 109, respectively, are stabilized at a predetermined voltage level by the sub-threshold leakage currents of internal circuit 111 and switching transistors 103*a* and 104.

Control signals SW and /SW are generated according to a signal that determines the period of the operation of internal circuit 111.

According to the third embodiment of the present invention, the sub-power source line is configured to be charged or discharged via a capacitor in the transition of the operation mode of the internal circuit. It is therefore not necessary to provide an additional switching transistor to recover the voltage level of the sub-power source line. The increase in the sub-threshold current in a standby state can be suppressed, and the voltage level of the sub-power source line can be recovered to a predetermined voltage level speedily. By virtue of a structure in which charges are supplied/discharged to/from a sub-power source line using a capacitive element, the effect such as the channel resistance and the like of the switching transistor is eliminated in comparison to the case where current flows through a switching transistor. The charges can be transmitted to the sub-power source line speedily to change the level of the voltage on the sub-power source line.

Since the voltage level of the sub-power source line can be recovered to a predetermined voltage level speedily, the internal circuit can be operated at a faster timing.

Fourth Embodiment

Figure 13:
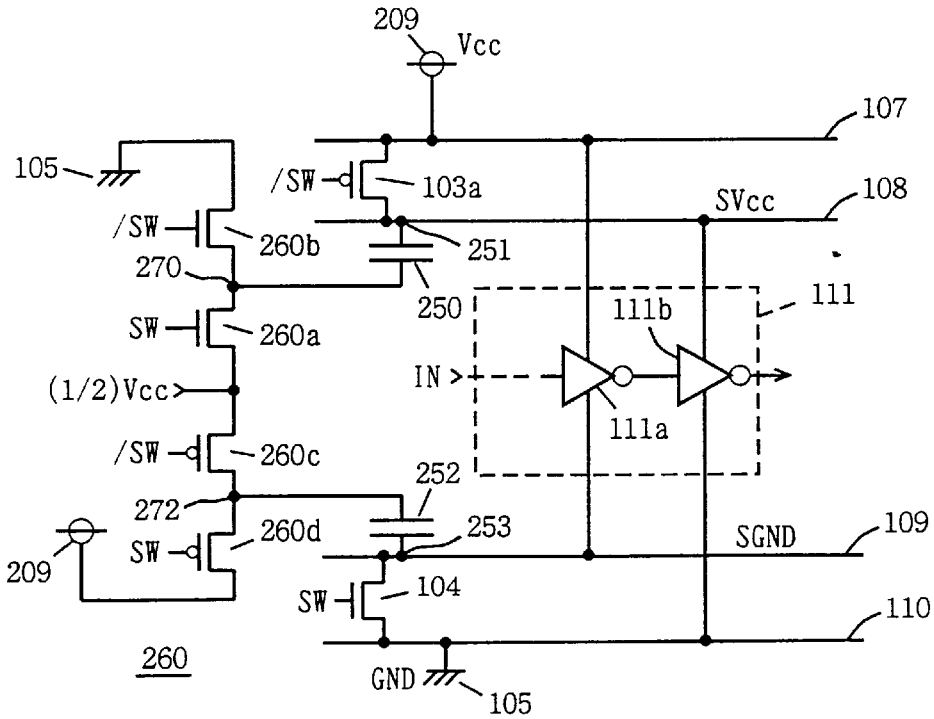
FIG. 13 represents a schematic structure of a fourth embodiment of the present invention.

FIG. 13 shows a structure of a semiconductor device according to a fourth embodiment of the present invention. Referring to FIG. 13, there are provided capacitors 250 and 252 having respective electrode nodes 251 and 253 connected to sub-power supply line 108 and sub-ground line 109, respectively, and a drive circuit 260 for driving capacitors 250 and 252 according to control signals SW and /SW. Switching transistor 103*a* is provided between main power supply line 107 and sub-power supply line 108, and is rendered conductive in response to activation of control signal /SW. Switching transistor 104 is provided between sub-ground lie 109 and main ground line 110, and is rendered conductive in response to activation of control signal SW. Internal circuit 111 operates using the voltage on these power source lines as operating power supply voltages to carry out a predetermined process according to input signal IN. Main power supply line 107 is connected to power supply node 109. Main ground line 110 is connected to ground node 105. Power supply node 209 may be an external power supply node, or an output node of an internal voltage-down converter.

Figure 14:
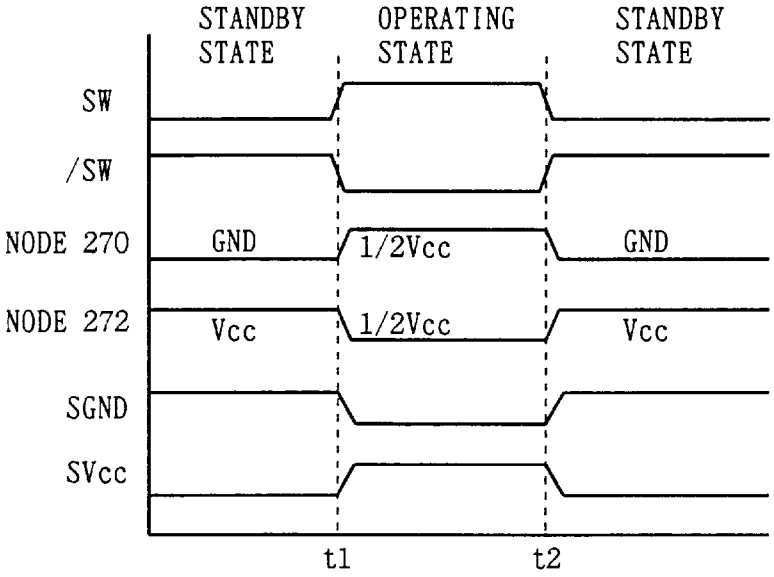
FIG. 14 is a signal waveform diagram representing an operation of the semiconductor device of FIG. 13.

Drive circuit 260 includes an n channel MOS transistor 260*a* rendered conductive in response to activation of control signal SW to transmit an intermediate voltage Vcc/2 to capacitor 250 via a node 270, an n channel MOS transistor 260*b* rendered conductive in response to inactivation of control signal /SW to electrically connect node 270 to ground node 105, a p channel MOS transistor 260*c* rendered conductive in response to activation of control signal /SW to transmit intermediate voltage Vcc/2 to capacitor 252 via a node 272, and a p channel MOS transistor 260*d* rendered conductive in response to inactivation of control signal SW to transmit voltage Vcc on power supply node 209 to node 272. The operation of the semiconductor device of FIG. 13 will now be described with reference to the signal waveform diagram of FIG. 14.

When internal circuit 111 is in a standby state, control signal SW is in an inactive state of an L level corresponding to the ground voltage, and control signal /SW is in an inactive state of an H level corresponding to power supply voltage Vcc. Under this state, switching transistors 103*a* and 104 are both inactive. Voltage SVcc on sub-power supply line 108 and voltage SGND on sub-ground line 109 have their voltage levels set to the levels determined by the sub-threshold current of internal circuit 111 and switching transistors 103*a* and 104.

In drive circuit 260, MOS transistor 260*b* is in a conductive state, whereas MOS transistor 260*a* is in a non-conductive state. Node 270 is charged to the level of ground voltage GND. MOS transistor 260*c* is non-conductive, and MOS transistor 260*d* is conductive. Node 272 is charged to the level of power supply voltage Vcc. Electrode nodes 251 and 253 of capacitors 250 and 252 are charged to the level of voltage SVcc and SGND, respectively.

When internal circuit 111 initiates operation, control signals SW and /SW are driven to an active state at time t1. In response to activation of control signals SW and /SW, switching transistors 103*a* and 104 conduct. The level of voltage SVcc on sub-power supply line 108 rises, whereas the level of voltage SGND on sub-ground line 109 is reduced. In drive circuit 260, MOS transistor 260*b* is rendered nonconductive, and MOS transistor 260*a* is rendered conductive. The voltage level of node 270 rises from the level of ground voltage GND to the level of intermediate voltage Vcc/2. According to the charge pumping operation of capacitor 250 in response to the rise of the voltage level at node 270, charges are supplied to sub-power supply line 208 via electrode node 251. Voltage SVcc on sub-power supply line 108 is recovered to the original level of voltage Vcc at a high speed. MOS transistor 260*c* is rendered conductive whereas MOS transistor 260*d* is rendered non-conductive. The voltage level at node 272 is pulled down from the level of power supply voltage Vcc to the level of intermediate voltage Vcc/2. Voltage SGND on sub-ground line 109 is reduced according to the charge pumping operation of capacitor 252. By the series of these operations, voltage SVcc on sub-power supply line 108 and voltage SGND on sub-ground line 109 arrives at a predetermined voltage level.

When the voltage level of node 272 falls from the level of power supply voltage Vcc to the level of intermediate voltage Vcc/2 in drive circuit 260, the charge in node 272 is transmitted to node 270 via MOS transistors 260*c* and 260*a* to be used again for charging node 270. Therefore, a current consumption is reduced.

When the operation of internal circuit 111 is completed, control signals SW and /SW are rendered inactive at time t2. Switching transistors 103*a* and 104 are rendered nonconductive. In drive circuit 260, MOS transistor 260*b* is rendered conductive, and MOS transistor 260*a* is rendered nonconductive. Node 270 is driven to the level of the ground voltage. MOS transistor 260*c* is rendered nonconductive, and MOS transistor 260*a* is rendered conductive. Node 272 is charged to the level of power supply voltage Vcc.

According to the structure shown in FIG. 13, the amplitude of the signal applied to capacitors 250 and 252 is Vcc/2. By setting an appropriate value for the capacitance of capacitors 250 and 252, voltages SVcc and SGND can be changed at a high speed. At the time of initiation of the operation of internal circuit 111, the charges in electrode node 272 of capacitor 252 are used for charging electrode node 270 of capacitor 250. Therefore, current consumption in driving capacitors 250 and 252 can be reduced.

It is not necessary to provide an additional switching transistor to recover the voltages on sub-power supply line 108 and sub-ground line 109. The sub-threshold leakage current can be suppressed from increasing during the standby state. By supplying charges via capacitors 250 and 252, the level of the voltages on sub-power supply line 108 and sub-ground lie 109 is changed. Voltages SVcc and SGND can be changed speedily.

[Modification]

Figure 15:
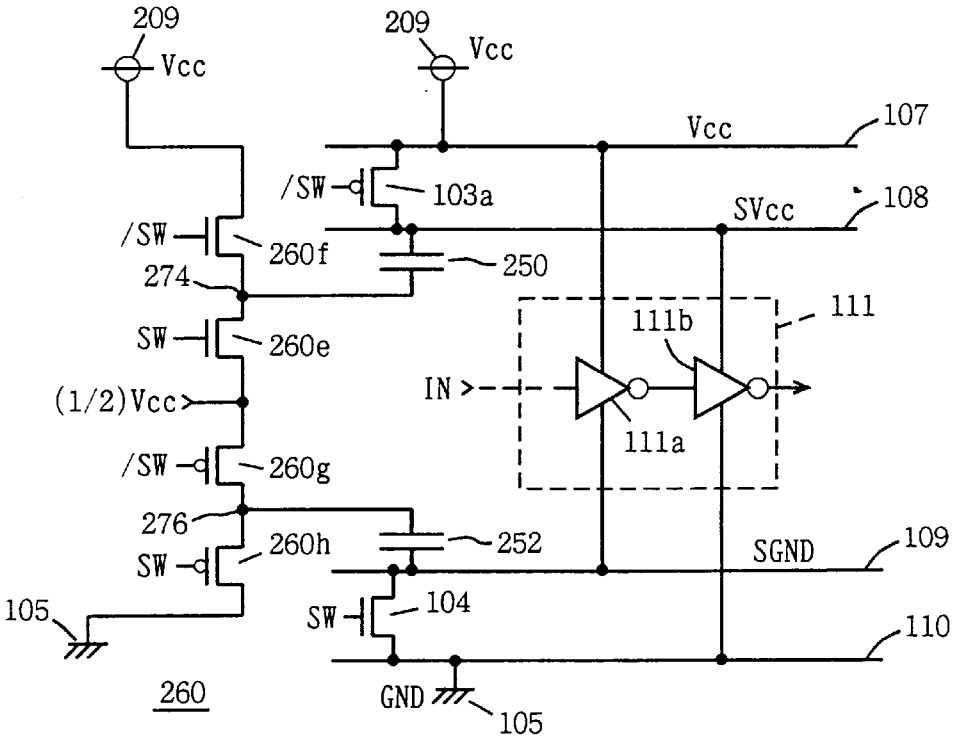
FIG. 15 represents a schematic structure of a modification of the fourth embodiment of the present invention.

FIG. 15 shows a modification of the fourth embodiment of the present invention.

Figure 16:
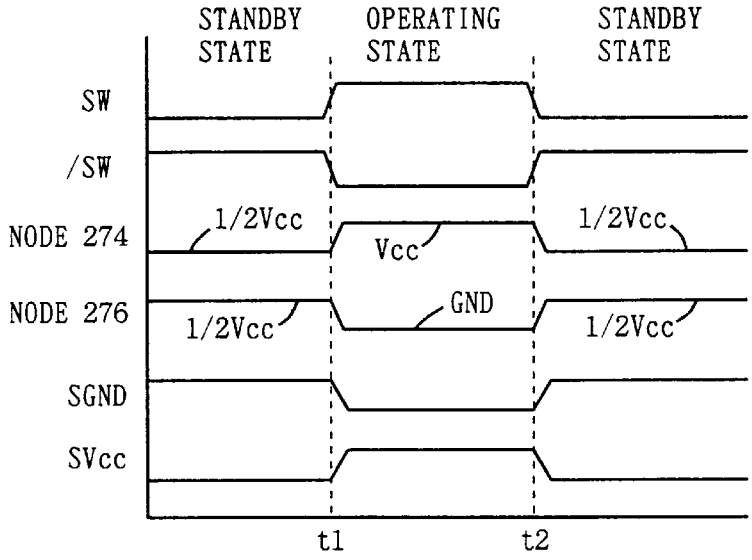
FIG. 16 is a signal waveform diagram representing an operation of the semiconductor device of FIG. 15.

The structure of FIG. 15 differs from the structure of FIG. 13 only in drive circuit 260. The remaining structure is identical to that of FIG. 13. Referring to FIG. 15, drive circuit 260 includes a p channel MOS transistor 260*f* rendered conductive in response to activation of control signal /SW to transmit voltage Vcc on power supply node 209 to node 274, a p channel MOS transistor 260*e* rendered conductive in response to inactivation of control signal SW to transmit intermediate voltage Vcc/2 to node 274, an n channel MOS transistor 260*g* rendered conductive in response to inactivation of control signal /SW to transmit intermediate voltage Vcc/2 to node 276, and an n channel MOS transistor 260*h* rendered conductive in the activation of control signal SW to transmit ground voltage GND to node 276. Capacitor 250 is connected between node 274 and sub-power supply line 108. Capacitor 252 is connected between node 276 and sub-ground line 109. The operation of the drive circuit of FIG. 15 will now be described with reference to the signal waveform diagram of FIG. 16.

When internal circuit 111 is inactive, i.e., in a standby state, control signals SW and /SW both are in an inactive state. Switching transistors 103*a* and 104 are at a non-conductive state. In drive circuit 260, MOS transistors 260*e* and 260*g* conduct to transmit intermediate voltage Vcc/2 to nodes 274 and 276, respectively. MOS transistors 260*f* and 260*h* are in an non-conductive state. In this state, the voltages of sub-power supply line 108 and sub-ground line 109 are determined by the sub-threshold currents of switching transistors 103*a* and 104 and internal circuit 111. Capacitors 250 and 252 each have one-electrode node charged to the level of the voltage on sub-power supply line 108 and sub-ground line 109, and the other electrode node receiving intermediate voltage Vcc/2. In this state, voltage SVcc of sub-power supply line 108 becomes lower than power supply voltage Vcc, whereas voltage SGND on sub-ground line 109 becomes higher than ground voltage GND.

When internal circuit 111 operates, control signals SW and /SW are rendered active at time t1. MOS transistors 260*e* and 260*g* are rendered non-conductive. Switching transistors 103 and 104 are rendered conductive to electrically connect main power supply line 107 to sub-power supply line 108 and main ground line 110 to sub-ground line 109.

In drive circuit 260, MOS transistor 260*f* conducts to supply power supply voltage Vcc from power supply node 209 to capacitor 250 via node 274. In response, capacitor 250 supplies charges to sub-power supply line 108 according to the change in voltage at that electrode node. As a result, the level of power supply voltage SVcc is raised. MOS transistor 260*h* conducts to discharge node 276 from the level of intermediate voltage Vcc/2 to the level of ground voltage GND. As a result, capacitor 252 draws charges from sub-ground line 109 to reduce the level of voltage SGND on sub-power supply line 109. Thus, voltages SVcc and SGND are recovered to a predetermined voltage level at a high speed.

When the operation of internal circuit 111 is completed, control signal SW and /SW are driven to an inactive state at time t2. Here, switching transistors 103*a* and 104 are rendered nonconductive, and MOS transistors 260*f* and 260*h* are also rendered non-conductive. MOS transistors 260*e* and 260*g* conduct to drive nodes 274 and 276 to the level of intermediate voltage Vcc/2. The charges of node 274 at the level of power supply voltage Vcc are transmitted to node 276 via MOS transistors 260*e* and 260*g*, and node 276 is driven to the level of the intermediate voltage. When the voltage of node 274 is reduced, the level of voltage SVcc on sub-power supply line 108 becomes lower. When the voltage level on node 276 is raised, voltage SGND on sub-ground line 109 becomes higher. At the transition to the standby state, the gate voltage of MOS transistor of internal circuit 111 is once set to a deep reverse-bias state to suppress the sub-threshold leakage current.

In drive circuit 260 of FIG. 15, sub-power supply line 108 and subground line 109 are each driven by the signal of an amplitude Vcc/2 via capacitors 250 and 252. Voltages SVcc and SGND can be driven to a predetermined voltage level at high speed. In the transition to a standby state from completion of an operation of internal circuit 111, the charges in node 274 are transmitted to node 276 in drive circuit 260 to be used to boost the voltage level thereof. Therefore, consumed current can be reduced.

According to the fourth embodiment of the present invention, the sub-power supply line and the sub-ground line are each driven via the capacitor receiving the drive signal of the intermediate voltage level of amplitude Vcc/2. In the drive circuit, the stored charges are used to charge the internal node. Therefore, current consumption is not increased. The voltages on the sub-power supply line and the sub-ground line can be driven to respective predetermined voltage levels at a high speed. The voltages of the sub-power supply line and the sub-ground line are changed using the capacitor. In contrast to the structure that supplies current using an MOS transistor, the voltage can be changed more speedily. Furthermore, it is not necessary to provide additional switching transistors for the sub-power supply line and the sub-ground line. Increase in the sub-threshold current in a standby state can be suppressed.

Fifth Embodiment

Figure 17:
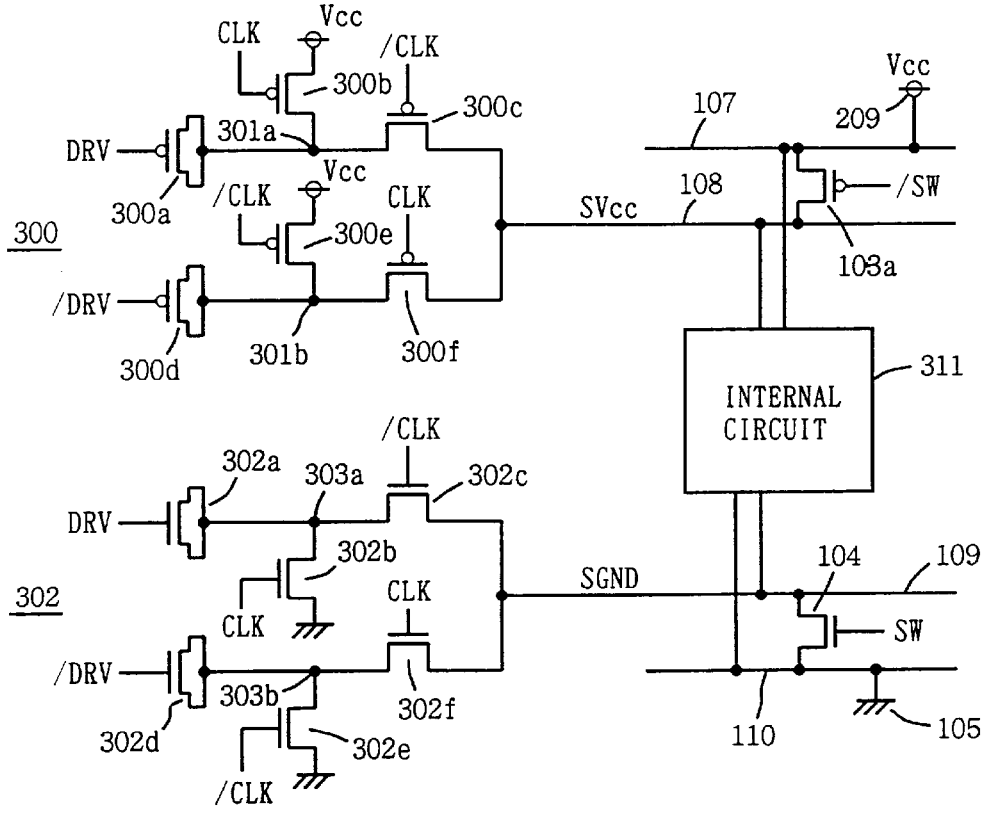
FIG. 17 represents a structure of a semiconductor device according to a fifth embodiment of the present invention.

FIG. 17 shows a structure of a semiconductor device according to a fifth embodiment of the present invention. Referring to FIG. 17, there are provided a drive circuit 300 with respect to sub-power supply line 108 for compensating for reduction of voltage SVcc on sub-power supply line 108 during operation of an internal circuit 311, and a drive circuit 302 with respect to sub-ground line 109 to prevent increase of voltage SGND on sub-ground line 109 during operation of internal circuit 311. Internal circuit 311 uses the voltages on main power supply line 107, sub-power supply line 108, sub-ground line 109, and main ground line 110. The connection of the power sources with the internal components in internal circuit 311 is determined according to the state of the output signal of each component when each of the internal components are in a standby state.

Drive circuit 300 includes a capacitor 300*a* formed of a p channel MOS transistor receiving a drive signal DRV, a p channel MOS transistor 300*b* rendered conductive when clock signal CLK is at an L level to charge a node 301*a* to the level of power supply voltage Vcc, a p channel MOS transistor 300*b* rendered conductive in response to a clock signal /CLK of an L level to transmit the charges stored on node 301*a* onto sub-power supply line 108, a capacitor 300*d* formed of a p channel MOS transistor receiving drive signal /DRV, a p channel MOS transistor 300*e* rendered conductive in response to clock signal /CLK of an L level to charge node 301*b* to the level of power supply voltage Vcc, and a p channel MOS transistor 300*f* rendered conductive in response to a clock signal CLK of an L level to transmit the charges at node 301*b* onto sub-power supply line 108. The reason why a p channel MOS transistor is used for capacitors 300*a* and 300*d* is that the voltage on sub-power supply line 108 becomes higher than the H level of drive signals DRV and /DRV.

Drive circuit 302 includes a capacitor 302*a* formed of an n channel MOS transistor receiving drive signal DRV, an n channel MOS transistor 302*b* rendered conductive in response to clock signal CLK of an H level to discharge node

303*a* to the level of ground voltage GND, an n channel MOS transistor 302*c* rendered conductive in response to clock signal /CLK of an H level to transmit charges on sub-ground line 109 to node 303*a*, a capacitor 302*d* formed of an n channel MOS transistor receiving drive signal /DRV, an n channel MOS transistor 302*e* rendered conductive in response to clock signal /CLK of an H level to discharge node 303*b* to the level of ground level GND, and an n channel MOS transistor 302*f* rendered conductive in response to clock signal CLK of an H level to transmit the charges on sub-ground line 109 to node 303*b*. The reason why an n channel MOS transistor is used for capacitors 302*a* and 302*d* is that the voltage level of nodes 303*a* and 303*b* becomes lower than the voltage of the L level of drive signals DRV and /DRV.

Drive signals DRV and /DRV are driven to an active state at a predetermined cycle during operation of internal circuit 311. Clock signals CLK and /CLK are generated when internal circuit 311 operates. The manner of generation of drive signals DRV and /DRV and clock signals CLK and /CLK will be described afterwards. The operation of the semiconductor device of FIG. 17 will now be described with reference to the signal waveform diagram of FIG. 18.

In an operation mode of internal circuit 311, clock signals CLK and /CLK and drive signals DRV and /DRV are altered at a predetermined cycle according to an activation signal of internal circuit 311. Clock signals CLK and /CLK make a transition at a timing faster than that of drive signals DRV and /DRV. When internal circuit 311 is active, control signals /SW and SW are active. Switching transistors 103*a* and 104 conduct. Main power supply line 107 is electrically connected to sub-power supply line 108, and sub-ground line 109 is electrically connected to main ground line 110.

Figure 18:
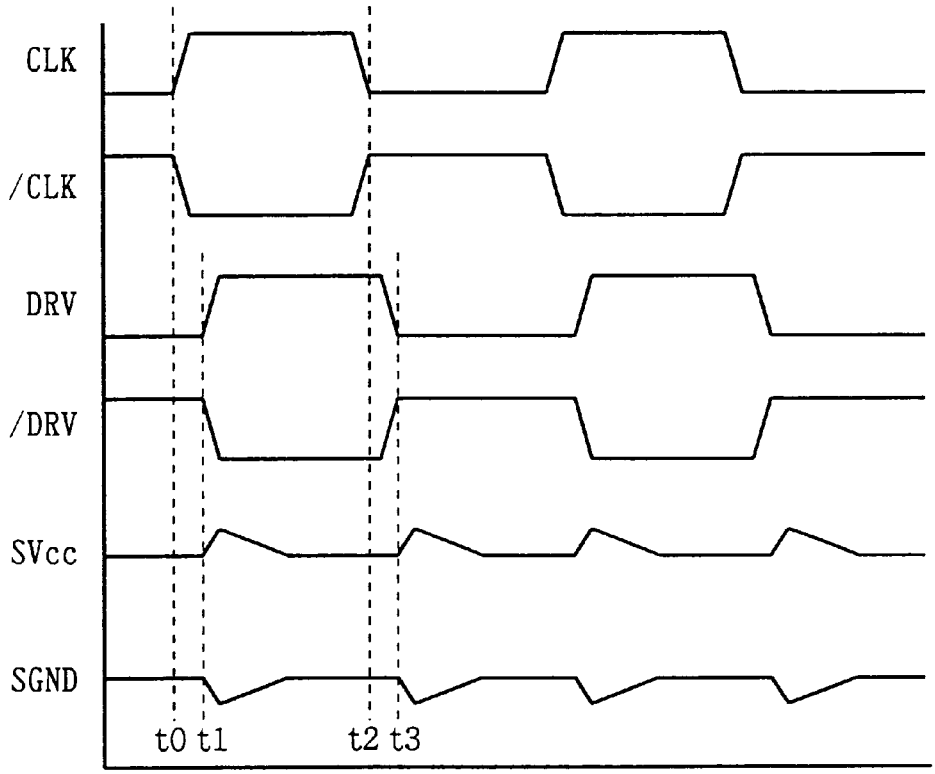
FIG. 18 is a signal waveform diagram representing an operation of the semiconductor device of FIG. 17.

At time t0 in FIG. 18, clock signal CLK is pulled up to an H level and clock signal /CLK is pulled down to an L level. In drive circuit 300, MOS transistor 300*c* conducts, whereas MOS transistor 300*f* is rendered non-conductive. Node 301*a* is electrically connected to sub-power supply line 108 to be charged to the level of power supply voltage Vcc by MOS transistor 300*b*. Node 301*b* is already disconnected from sub-power supply line 108. Node 301*b* is already charged to the level of power supply voltage Vcc by MOS transistor 300*e*.

Under this state, drive signal DRV is pulled up to an H level whereas drive signal /DRV is pulled down to an L level at time t1. Charges are supplied to node 301*a* from capacitor 300*a*. The supplied charges are transmitted to sub-power supply line 108, whereby the level of voltage SVcc on sub-power supply line 108 is raised. Node 301*b* is maintained at the level of power supply voltage Vcc by MOS transistor 300*e* even when drive signal /DRV is pulled down to an L level. Internal circuit 311 includes a logic circuit that operates using voltage SVcc on sub-power supply line 108. Therefore, voltage SVcc raised in level on sub-power supply line 108 is prevented from becoming lower than a predetermined voltage (Vcc) level during operation of internal circuit 311. Thus, internal circuit 311 can operate stably.

In drive circuit 302, node 303*b* is electrically connected to sub-ground line 109 whereas node 303*a* is disconnected from sub-ground line 109 in response to the rise of clock signal CLK at time t0. Therefore, node 303*a* is discharged to the level of ground voltage GND by MOS transistor 302*b*.

When drive signal DRV is pulled up to an H level and complementary drive signal /DRV is pulled down to an L level at time t1, the voltage level of node 303*b* further becomes lower than the ground voltage level due to the charge pumping operation of capacitor 302*d*. As a result, voltage SGND on sub-power supply line 109 is also reduced. Although node 303*a* is temporarily raised in voltage level by the charge from capacitor 302*a*, node 303*a* is discharged to the level of ground voltage GND by MOS transistor 302*b*.

By raising in advance the voltage level of voltage SVcc on sub-power supply line 108 and reducing the voltage level of voltage SGND on sub-ground line 109 in an operation mode of internal circuit 311, variation in level of these voltages toward the intermediate voltage level can be prevented even when voltages SVcc and SGND are consumed upon operation of internal circuit 311. Therefore, internal circuit 311 can be operated stably (since reduction in the effective voltage (amplitude of operating power supply voltages) of internal circuit 311 can be prevented).

At time t2, clock signal CLK is pulled down to an L level from an H level, whereas clock signal /CLK is pulled up to an H level from an L level. In drive circuit 300, MOS transistor 300*c* is rendered conductive, whereas MOS transistor 300*f* is rendered conductive. Node 301*b* charged to the level of power supply voltage Vcc by p channel MOS transistor 300*e* is electrically connected to sub-power supply line 108. Node 301*a* is disconnected from sub-power supply line 108, and charged to the level of power supply voltage Vcc by MOS transistor 300*b*.

In drive circuit 302, MOS transistor 302*c* conducts to electrically connect node 303*a* discharged to the level of ground voltage GND to sub-ground line 109. Node 303*b* is disconnected from sub-ground line 109, and discharged to the level of ground voltage GND by MOS transistor 302*e*.

At time t3, drive signal DRV is pulled down from an H level to an L level, whereas complementary drive signal /DRV is pulled up from an L level to an H level. Charges are supplied to node 301*b* from capacitor 300*d*. Accordingly, the level of voltage SVcc on sub-power supply line 108 is raised. The voltage level of node 303*a* is further reduced than the level of ground voltage GND by capacitor 302*a*. Accordingly, the level of voltage SGND on sub-ground line 109 is further reduced. Internal circuit 311 operates again under this state. The charging and discharging operation of drive circuits 300 and 302 is repeated according to clock signals CLK and /CLK and drive signals DRV and /DRV thereafter.

When the operation of internal circuit 311 is completed, the activation of clock signals CLK and /CLK and drive signals DRV and /DRV is ceased. At the cessation of the operation of internal circuit 311, node 301*a* is electrically connected to sub-power supply line 108 and node 303*b* is electrically connected to sub-ground line 109 if clock signal CLK is at an H level and clock signal /CLK is at an L level. In this case, MOS transistor 300*b* provided to node 301*a* is in a non-conductive state. MOS transistor 302*e* provided to node 303*b* is also in a non-conductive state. Drive signals DRV and /DRV make no transition. Therefore, capacitor 300*a* is electrically connected to sub-power supply line 108, and sub-ground line 109 is electrically connected to capacitor 302*d*.

Switching transistors 103*a* and 104 are non-conductive. Therefore, when internal circuit 311 is in a standby state, the sub-threshold current from MOS transistor 300*b* and the sub-threshold current of switching transistor 103*a* flow to sub-power supply line 108. Also, the sub-threshold current of switching transistor 104 and MOS transistor 302*e* flow in subground line 109. By these sub-threshold currents and the sub-threshold current of internal circuit 311, voltage SVcc on sub-power supply line 108 becomes lower than the level of power supply voltage Vcc. Voltage SGND on sub-ground line 109 becomes higher than the level of ground voltage GND. Therefore, the sub-threshold leakage current of internal circuit 311 can be suppressed.

When drive signals DRV and /DRV attain an H level and an L level, respectively, in a standby mode, the channel is not formed in MOS transistors 300*a* and 302*d*, and the capacitance thereof can be set small enough. Therefore, the change in voltage SVcc and SGND is not so affected.

By supplying or drawing charges with respect to sub-power supply line 108 and sub-ground line 109 using the capacitor during the operation mode of internal circuit 311, the voltage level of sub-power supply line 108 and sub-ground line 109 is changed from the predetermined level to suppress reduction in the effective voltage for internal circuit 311. Therefore, internal circuit 311 can operate stably.

Figure 19:
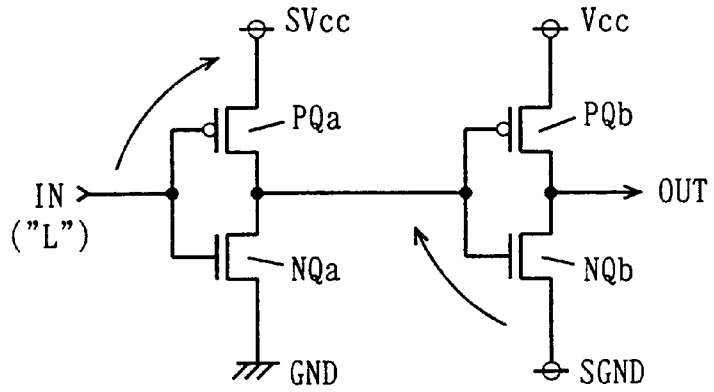
FIG. 19 is a diagram for explaining the effect of the semiconductor device of FIG. 17.

FIG. 19 shows an example of a structure of an internal circuit. Referring to FIG. 19, the internal circuit includes two stages of cascaded inverters. The first stage inverter includes p channel MOS transistor PQa and an n channel MOS transistor NQa. The second stage inverter includes a p channel MOS transistor PQb and an n channel MOS transistor NQb. MOS transistor PQa has its source connected to receive voltage SVcc on the sub-power supply line. MOS transistor NQa has its source connected to receive voltage GND on the main ground line. MOS transistor PQb has its source connected to receive voltage Vcc on the main power supply line. MOS transistor NQb has its source connected to receive voltage SGND on the sub-ground line.

According to the structure of the internal circuit of FIG. 19, MOS transistor PQa conducts when input signal IN is at an L level. When the level of voltage SVcc on the sub-power supply line is reduced, the source-gate voltage difference of MOS transistor PQa becomes smaller. In response, the current driving capability of MOS transistor PQa becomes smaller, so that the output node cannot be charged at a high speed. The next stage inverter receives a signal of an H level from MOS transistor PQa. When the level of voltage SGND on the sub-ground line is raised, the gate-source voltage difference of MOS transistor NQb becomes smaller. Therefore, MOS transistor NQb cannot discharge output signal OUT to the level of the ground voltage at high speed. Particularly in the case where voltage SVcc on the sub-power supply line is reduced and voltage SGND on the sub-ground line is increased, the gate-source voltage of MOS transistor NQb is further reduced to limit the current drivability of MOS transistor NQb. Therefore, discharging cannot be carried out at a high speed.

However, by increasing in absolute value the voltage SVcc on the sub-power supply line and voltage SGND on the sub-ground line, respectively, voltage SVcc will not become lower than the predetermined voltage level even when voltage SVcc on the sub-power supply line is consumed upon operation of the internal circuit. The output node of MOS transistor PQa can be driven with a desired current drivability. Similarly, since voltage SGND does not become higher than the predetermined voltage level, MOS transistor NQb can discharge output signal OUT speedily without being limited by the current drivability thereof Particularly, reduction in the current drivability of MOS transistor NQb can be prevented since the gate voltage of MOS transistor NQb does not become lower than the predetermined voltage (Vcc) level.

Here, MOS transistor PQb can be reliably rendered non-conductive to suppress the flow of through current via MOS transistors PQb and NQb.

Figure 20:
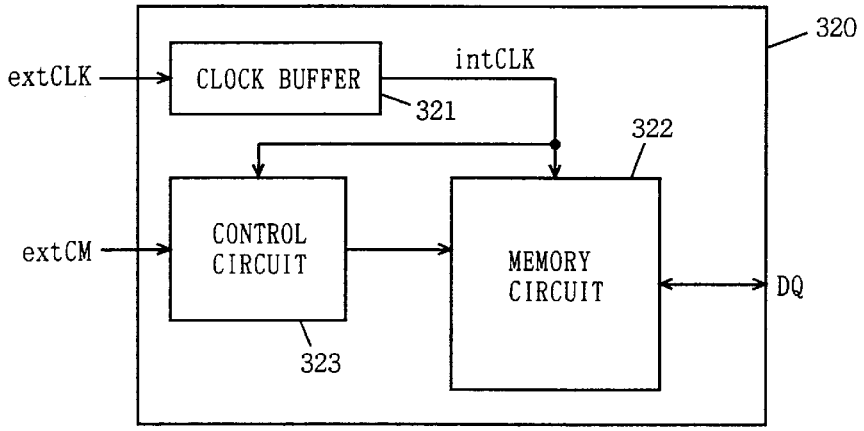
FIG. 20 represents a schematic structure of an entire circuit device including the semiconductor device of FIG. 17.

FIG. 20 schematically shows an entire structure of a semiconductor device with the hierarchical power source structure. In FIG. 20, the arrangement of the power sources are not illustrated. Semiconductor device 320 of FIG. 20 includes a clock buffer 321 applying a buffering process on an externally applied clock signal extCLK to generate an internal clock signal intCLK, a memory circuit 322 including a plurality of memory cells, and a control circuit 323 for controlling an access operation memory circuit 322 according to an externally applied command extCM. Memory circuit 322 includes a circuit for selecting a row of memory cells, a circuit for selecting a column of memory cells, and a circuit for writing/reading data. Memory circuit 322 and control circuit 323 operate in synchronization with internal clock signal intCLK from clock buffer 321. Control circuit 323 identifies a specified operation mode to provide various controls for performing the specified operation mode according to an externally applied command extCM (a plurality of external signals).

The semiconductor device of FIG. 20 is a clock synchronous type memory and takes in external command extCM in synchronization with clock signal extCLK that is repeatedly applied and inputs/outputs data in synchronization with clock signal extCLK. By adjusting the voltage level of the sub-power supply line and the sub-ground line in response to clock signal CLK as shown in FIG. 18, variation in the operating power supply voltage during operation of control circuit 323 and memory circuit 322 can be suppressed to allow stable operation. A circuit that operates for each clock cycle will be described hereinafter.

Figure 21:
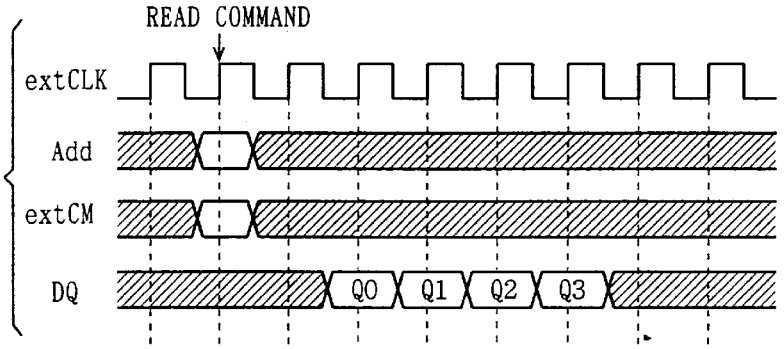
FIG. 21 is a timing chart representing an operation of the semiconductor circuit device of FIG. 20.

FIG. 21 is a timing chart representing an operation of reading out data of a semiconductor device (clock synchronous type memory) of FIG. 20. In the clock synchronous type memory of FIG. 21, a command and an external address signal Add are taken in synchronization with external clock signal extCLK. When a read command to read out data is applied, external command extCM is set to this read command state and an external address Add is also supplied. Using address signal Add applied together with the read command as the head address, a select operation of a memory cell is carried out internally. When a memory cell is selected in memory circuit 322, a certain period of time (called CAS latency) is required until data is output externally. At the elapse of this period, data is output in synchronization with clock signal extCLK.

Using address signal Add applied together with the read command as the head address in a read out mode, a column address is generated by means of a burst address counter for each clock cycle, and a memory cell column is sequentially selected to read out data from a selected memory cell. In this case, selection of a memory cell column and data read-out/transfer are executed in each clock cycle. In other words, the circuit related to column selection and read-out is operated for each clock cycle. In writing data, an internal transfer circuit and write circuit operate in each clock cycle. Therefore, by adjusting the voltage level on the sub-power supply line and sub-ground line according to clock signal CLK and drive signal DRV as shown in FIG. 18, the column select circuit, the data read/write circuit, and the transfer circuit can be operated stably even when the power sources of these circuits are implemented in a hierarchical power supply structure.

Figure 22:
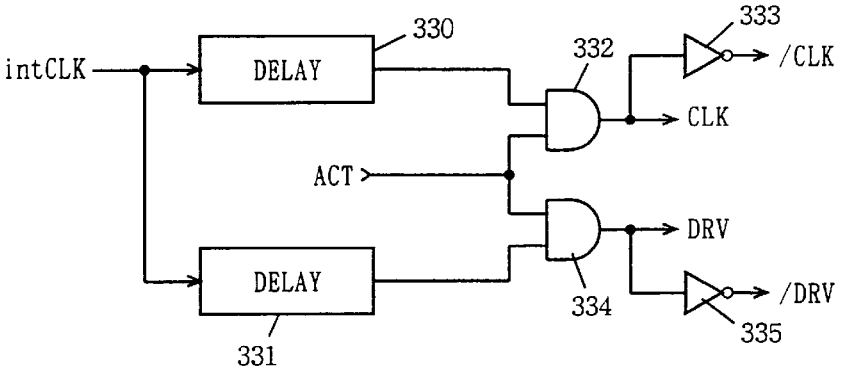
FIG. 22 shows an example of a structure of a generation unit of the clock signal and drive signal of FIG. 19.

FIG. 22 shows an example of a structure of a clock signal and drive signal generation unit. Referring to FIG. 22, the clock/drive signal generation unit includes a delay circuit 330 for delaying internal clock signal intCLK by a predetermined time, a delay circuit 331 for delaying internal clock signal intCLK by a delay time longer than the delay time of delay circuit 330, an AND circuit 332 receiving an output signal of delay circuit 330 and internal circuit activation signal ACT for generating a clock signal CLK, an inverter circuit 333 for inverting the output signal of AND circuit 332 to generate a complementary clock signal /CLK, an AND circuit 334 receiving internal circuit activation signal ACT and the output signal from delay circuit 331 to output a drive signal DRV, and an inverter circuit 335 for inverting the output signal of AND circuit 334 to generate a complementary drive signal /DRV.

The clock/drive signal generation unit of FIG. 22 is included in control circuit 323 of FIG. 20. Internal circuit activation signal ACT is a signal controlling the activation/inactivation of the circuit that employs the hierarchical power source. Signal ACT is generated according to an external command and maintained at an H level of an active state during activation of the internal circuit.

By using the clock/drive signal generation unit of FIG. 22, the voltage level of the sub-power supply line and the sub-ground line in each clock cycle of internal clock signal intCLK during operation of the internal circuit can be adjusted.

In a memory such as a standard DRAM that uses external row address strobe signal /RAS and column address strobe signal /CAS, clock signal CLK and drive signal DRV can be generated according to these address strobe signals /RAS or /CAS. In such a structure, the voltage level of the power source line is adjusted once in each cycle of row address strobe signal /RAS or column address strobe signal /CAS.

The semiconductor device of the present invention is not limited to a memory, and can be any integrated circuit device having its operation cycle defined by an external clock signal extCLK and a control signal setting activation/inactivation of an internal circuit generated internally. For example, a portable telephone can be included.

According to the fifth embodiment of the present invention, the voltage level of the sub-power source line is adjusted in advance in the operation of the internal circuit. Reduction in the effective voltage during operation of the internal circuit can be suppressed to allow stable operation of the internal circuit.

Sixth Embodiment

Figure 23:
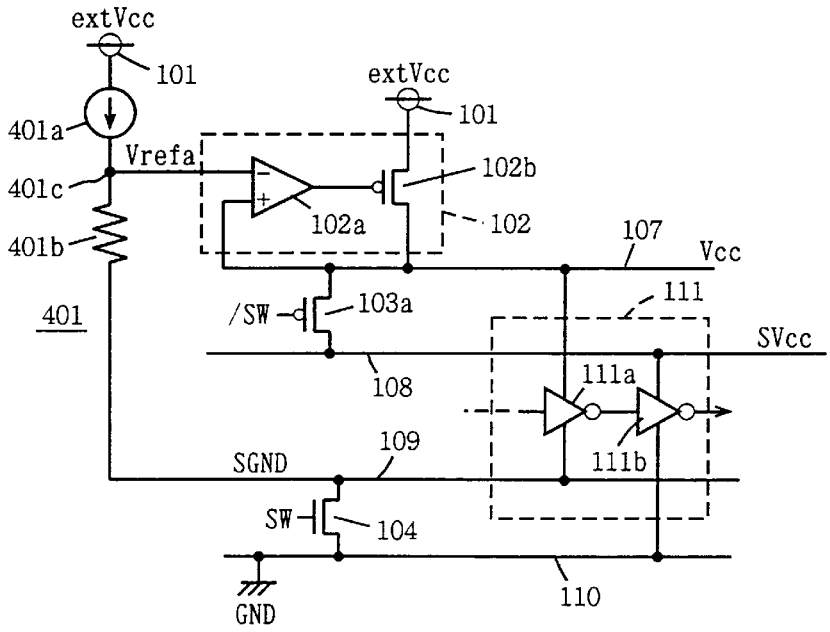
FIG. 23 represents a structure of a semiconductor device according to a sixth embodiment of the present invention.

FIG. 23 schematically shows a structure of a semiconductor device according to a sixth embodiment of the present invention. In the structure of FIG. 23, an internal voltage-down converter 102 is provided for main power supply line 107 to down-convert external power supply voltage extVcc to generate internal power supply voltage Vcc. Internal voltage-down converter 102 compares a reference voltage Vrefa from reference voltage generation circuit 401 with voltage Vcc on main power supply line 107 to supply current from external power supply node 101 to main power supply line 107 according to the comparison result. Therefore, internal power supply voltage Vcc on main power supply line 107 attains the voltage level of reference voltage Vrefa.

Reference voltage generation circuit 401 includes a constant current circuit 401*a* coupled to an external power supply node 101 to supply a constant current, and a resistance element 401*b* connected between a node 401*c* and sub-ground line 109 for generating reference voltage Vrefa to node 401*c* according to the current from constant current circuit 401*a*. Reference voltage Vrefa generated by reference voltage generation circuit 401 is represented by the following equation.

$$Vrefa=I\cdot R+SGND$$

where I indicates the current supplied by constant current circuit 401*a*, and R indicates the resistance of resistance element 401*b*. Therefore, reference voltage Vrefa depends upon voltage SGND on sub-ground line 109. Switching transistor 103*a* is provided between main power supply line 107 and sub-power supply line 108. Switching transistor 104 is provided between main ground line 110 and sub-ground line 109. Internal circuit 111 operates using the voltage on sub-power supply line 108 or main power supply line 107 as one operating power supply voltage. The operation of the semiconductor device of FIG. 23 will now be described with reference to the signal waveform diagram of FIG. 24.

Figure 24:
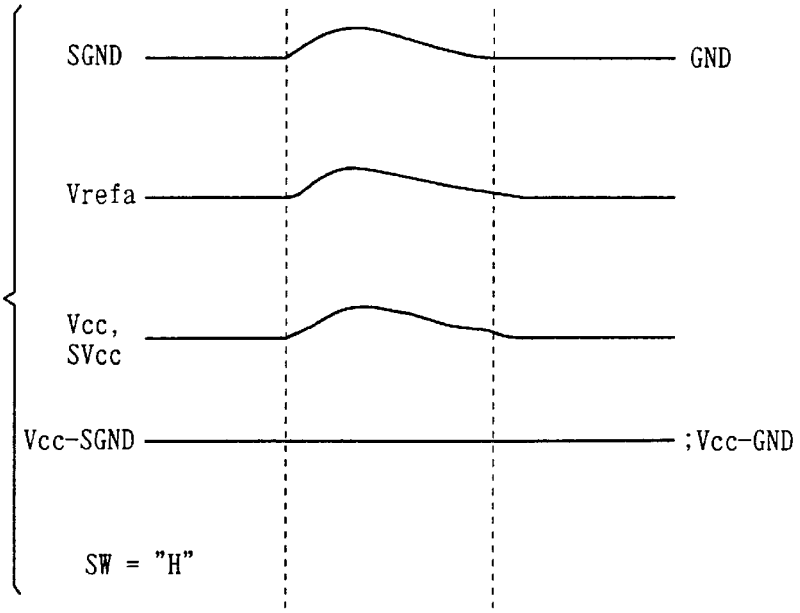
FIG. 24 shows variation in the voltage of the power supply/ground line of the semiconductor device of FIG. 23.

FIG. 24 shows the voltage waveform of each power source line when control signal SW is at an H level and control circuit 111 is in an operating state. Internal voltage-down converter 102 generates an internal power supply voltage Vcc equal to the level of reference voltage Vrefa on main power supply line 107. When internal circuit 111 operates so that voltage SGND on sub-ground line 109 increases according to the discharging current of, for example, logic circuit 111*a*, the level of reference voltage Vrefa also rises. In internal voltage-down converter 102, comparator 102*a* compares internal power supply voltage Vcc on main power supply line 107 with reference voltage Vrefa to drive transistor 102*b* according to the comparison result. The voltage level of the output signal of comparator 102*a* becomes lower according to the rise of the level of reference voltage Vrefa, so that drive transistor 102*b* has a greater conductance. Current is supplied from external power supply node 101 to main power supply line 107 to raise the level of internal power supply voltage Vcc.

Internal power supply voltage Vcc on main power supply line 107 is also transmitted onto sub-power supply line 108 via switching transistor 103*a*. Since internal power supply voltage Vcc on main power supply line 107 rises according to the increase of voltage SGND on sub-ground line 109, the effective voltage (Vcc-SGND) for logic circuit 111a in internal circuit 111 attains a constant level of voltage (Vcc-GND). Therefore, logic circuit 111*a* operates stably and speedily, independent of the rise of the level of voltage SGND on sub-ground line 109. Logic circuit 111*b* operates with voltage SVcc on sub-power supply line 108 and ground GND on main ground line 110 used as both operating power supply voltages, and the effective voltage thereof is increased according to the rise of voltage Vcc on main power supply line 107. Therefore, operation is performed speedily.

In an operation state of internal circuit 111, the effective voltage is not reduced so that the internal circuit can operate stably even if the level of voltage SGND on sub-ground line 109 increases.

When the voltage on the sub-ground line is varied, the effective voltage of the circuit that operates using the voltages on the main power supply line and the sub-ground line as both operating power supply voltages can be set constant to allow stable operation of the internal circuit by changing the voltage on the main power supply line in a direction identical to the changing direction of the voltage on the sub-ground line. By changing the level of the internal power supply voltage on the main power supply line in the same direction at the time of change in the voltage on the sub-ground line, any change in the voltage level on the sub-ground line can be equivalently cancelled to recover the voltage on the sub-ground line to the original voltage level equivalently. The effective voltage can be maintained at a constant level.

[First Modification]

Figure 25:
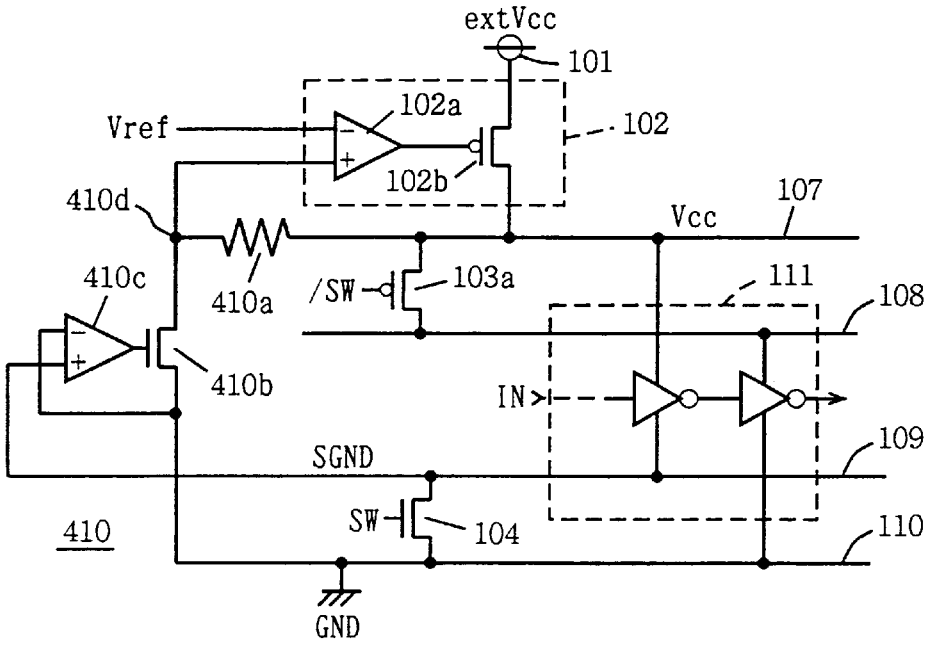
FIGS. 25, 26, 27, and 28 represent respective modifications of the sixth embodiment of the present invention.

FIG. 25 shows a structure of a first modification of the sixth embodiment of the present invention. In the structure of FIG. 25, the output voltage of a voltage divider 410 that divides the voltage on main power supply line 107 is provided to an internal voltage-down converter 102. Internal voltage-down converter 102 compares reference voltage Vref of a constant voltage level that is not dependent upon power supply voltage and the output voltage from voltage divider 410 to adjust the voltage level on main power supply voltage 107 according to the comparison result.

Voltage divider 410 includes a resistance element 410*a* and a variable conductance element 410*b* formed of an n channel MOS transistor connected in series between main power supply line 107 and main ground line 110, and a comparator 410*c* comparing voltage GND on main ground line 110 and voltage SGND on sub-ground line 109 to adjust the conductance of variable resistance element 410*b* according to the comparison result. The voltage on a node 410*d* to which resistance element 410*a* and variable conductance element 410*b* are connected is applied to internal voltage-down converter 102. The operation of the semiconductor device of FIG. 25 will now be described.

Internal voltage-down circuit 102 compares reference voltage Vref and the voltage on node 410 to adjust the level of internal power supply voltage Vcc on main power supply line 107 such that the voltage level of node 410*d* becomes equal to the level of reference voltage Vref. The voltage of node 410*d* is represented by the following equation.

$$V(\mathbf{410}d)=Vcc\cdot Rb/(Ra+Rb)$$

where Ra and Rb indicate the resistance values of resistance element 410*a* and variable conductance element 410*b*, respectively.

Switching transistors 103*a* and 104 both conduct when internal circuit 111 attains an operating state. When voltage SGND on sub-ground line 109 increases according to the operation of internal circuit 111, the voltage level of the output signal of comparator 410*c* increases. (Comparator 210*c* receives voltage SGND on sub-ground line 109 at its positive input.) In response, the conductance of variable conductance element 410*b* increases (resistance becomes smaller), so that the voltage level on node 410*d* is reduced (refer to above equation). In this state, the voltage level of the output signal of comparator 102*a* in internal voltage-down converter 102 is reduced. Current is supplied from external power supply node 101 to main power supply line 107 via drive transistor 102*b*, whereby the voltage level of internal power supply voltage Vcc is increased. Therefore, the effective voltage for internal circuit 111 can be made constant since the level of internal power supply voltage Vcc on main power supply line 107 increases according to the rise of voltage SGND on subground line 109.

Internal power supply voltage Vcc attains the level represented by Vref.(Ra+Rb)/Rb. By appropriately adjusting the sensitivity of comparator 410*c* in voltage divider 410, a change in voltage substantially equal to that of voltage SGND on sub-ground line 109 can be caused in power supply voltage Vcc on main power supply line 107.

It is to be noted that the resistance values of the resistance element and the variable conductance element connected in series between main power supply line 107 and main ground line 110 in voltage divider 410 is set to a relatively great value from the standpoint of reducing current consumption.

[Second Modification]

Figure 26:
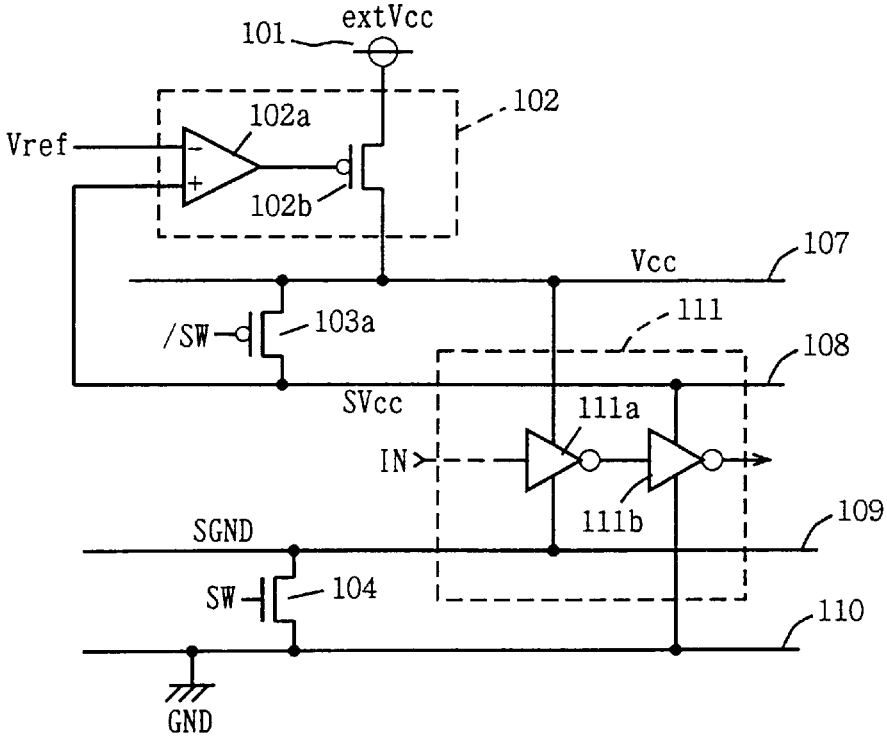

FIG. 26 shows a structure of a second modification of the sixth embodiment of the present invention. According to the structure of FIG. 26, internal voltage-down converter 102 compares voltage SVcc on sub-power supply line 108 with the constant reference voltage Vref to adjust the level of internal power supply voltage Vcc on main power supply line 107 according to the comparison result.

Switching transistor 103*a* rendered conductive in response to activation of control signal /SW is provided between main power supply line 107 and sub-power supply line 108. Switching transistor 104 rendered conductive in response to control signal SW is provided between main ground line 110 and sub-ground line 109.

When the level of power supply voltage SVcc on sub-power supply line 108 is reduced during activation of internal circuit 111, internal voltage-down converter 102 supplies current to main power supply line 107 to drive the level of voltage SVcc on sub-power supply line 108 to the level of reference voltage Vref. The voltage on main power supply line 107 is transmitted to sub-power supply line 108 via switching transistor 103*a*. The level of voltage SVcc on sub-power supply line 108 is recovered to the original voltage level. Therefore, reduction in the power supply voltage of logic circuit 111*b* included in internal circuit 111 is suppressed at a high speed to keep the effective voltage substantially constant. Therefore, logic circuit 111*b* can be operated stably.

When the level of voltage SGND on sub-ground line 109 rises according to the operation of logic circuit 111*a*, the level of internal power supply voltage Vcc on main power supply line 107 rises by internal voltage-down converter 102 to equivalently cancel the rise of the level of voltage SGND on sub-ground line 109. When internal circuit 111 operates to consume the current to reduce voltage SVcc on main power supply line 108 and to raise voltage SGND on sub-ground line 109, the effective voltage for all the logic circuits in internal circuit 111 can be made substantially constant by operating internal voltage-down converter 102 such that voltage SVcc on sub-power supply line 108 is made equal to the level of reference voltage Vref to set internal power supply voltage Vcc on main power supply line 107 higher than the predetermined voltage level (considering the channel resistance of switching transistor 103*a*). Therefore, internal circuit 111 can operate stably. Thus, a semiconductor device is realized that operates stably without being affected by voltage variation of the sub-power source line.

[Third modification]

Figure 27:
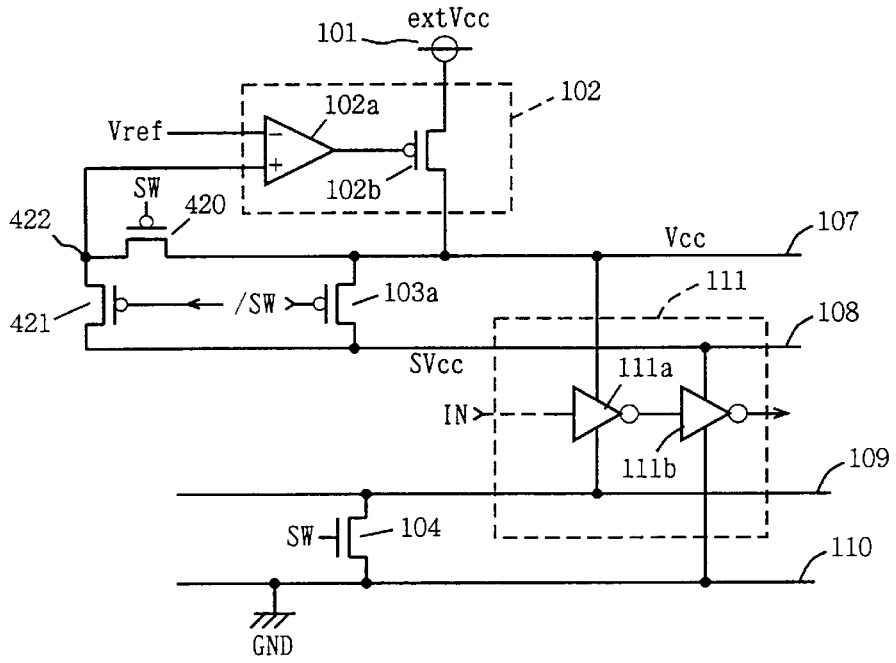

FIG. 27 shows a structure of a third modification according to the sixth embodiment of the present invention. The semiconductor device of FIG. 27 differs from the device of FIG. 26 in that the positive input of comparator 102*a* in internal voltage-down converter 102 is coupled to main power supply line 107 via a p channel MOS transistor 420 that is rendered conductive in response to inactivation of control signal SW, and also connected to sub-power supply line 108 via a p channel MOS transistor 421 rendered conductive in response to activation of control signal /SW.

According to the structure shown in FIG. 27, control signals SW and /SW are at an L level and an H level, respectively, in a standby state. Therefore, switching transistor 103*a* and MOS transistor 421 are rendered non-conductive, and MOS transistor 420 is rendered conductive. Under this state, internal voltage-down circuit 102 maintains voltage Vcc on main power supply line 107 at the level of reference voltage Vref.

In an operating state, control signals /SW and SW are at an L level and an H level, respectively. MOS transistor 420 is non-conductive whereas MOS transistor 421 and switching transistor 103*a* are conductive. In this operating state, a structure identical to that of FIG. 26 is realized to allow suppression in reduction of the effective voltage during operation of internal circuit 111. In a standby state, the voltage level on main power supply line 107 is compared with reference voltage Vref to supply current onto main power supply line 107 according to the comparison result. In contrast to the case where the voltage on sub-power supply line 108 is compared, internal power supply voltage Vcc on main power supply line 107 can be prevented from being raised unnecessarily by internal voltage-down converter 102. Thus, current consumption can be reduced.

[Fourth Modification]

Figure 28:
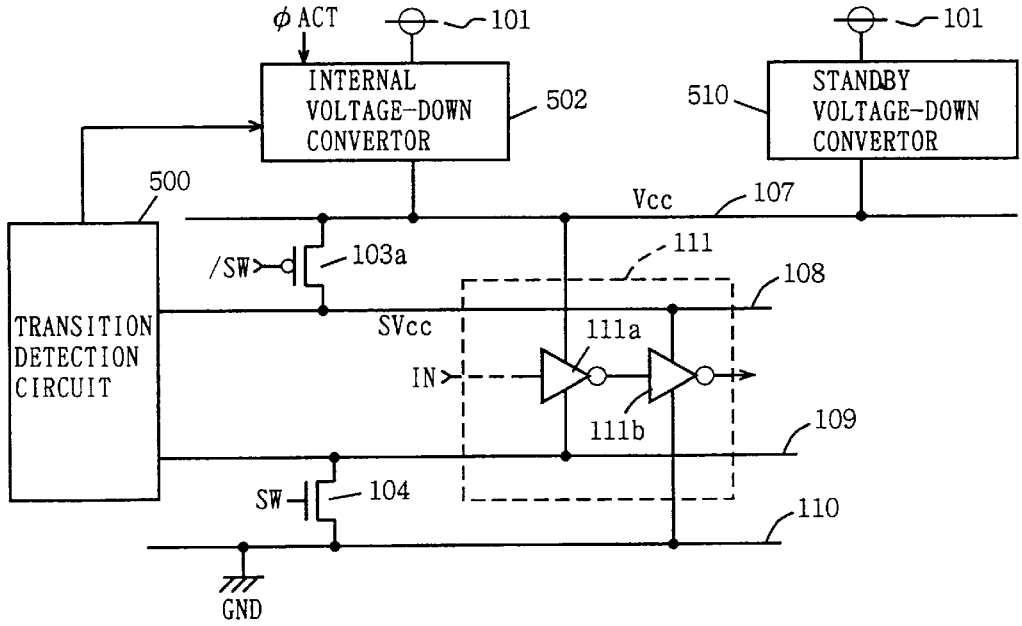

FIG. 28 shows a structure of a fourth modification according to the sixth embodiment of the present invention. According to the structure of FIG. 28, an internal voltage-down converter 502, which supplies current to main power supply line 107 from external power supply node 101 according to an output signal of a transition detection circuit 500 that detects a transition of the voltage on sub-power supply line 108 or sub-ground line 109, is rendered active only during the activation period of activation signal ϕACT that determines the activation period of internal circuit 111. A standby voltage-down converter 510 having a small current drivability and operating constantly is provided for main power supply line 107. Standby voltage-down converter 510 maintains the level of voltage Vcc on main power supply line 107 at the level of reference voltage Vref. Internal voltage-down converter 502 has a structure similar to that of internal voltage-down converter 102 shown in FIGS. 23, 25, 26 and 27 except for the feature that comparator 102*a* is activated in response to activation signal ϕACT. Transition detection circuit 500 generically represents the circuits that detect transition in the voltage level on sub-power supply line 108 or sub-ground line 109 shown in FIGS. 25–27. Therefore, when activated, internal voltage-down converter 502 operates to adjust the level of voltage Vcc on main power supply line 107 so as to cancel variation in the voltage detected by transition detection circuit 500.

According to the structure of FIG. 28, internal voltage-down circuit 502 must change the voltage level of main power supply line 107 at a high speed in response to voltage variation on sub-power supply line 108 or sub-ground line 109 during operation of internal circuit 111. Therefore, a relatively great current drivability is required (the response speed must be increased). In order to reduce current consumption in a standby state, internal voltage-down converter 502 operates only during the activation period of internal circuit 111. In a standby state, standby voltage-down converter 510 operates to compensate for reduction in the voltage level of internal power supply voltage Vcc caused by the leakage current on main power supply line 107. Thus, a semiconductor device can be realized that has current consumption reduced in a standby state and that can have the voltage level on the sub-power source line stably maintained at a constant voltage level during an active period (operating period of internal circuit).

In the structures of FIGS. 23–28, the voltage level on the main power supply line is changed. However, by using a negative voltage supply node instead of an external power supply node, the voltage level on the main ground line can be adjusted according to change in the voltage level on the sub-power supply line or the sub-ground line.

According to the sixth embodiment of the present invention, the voltage level on the main power source line is changed to cancel variation, if any, in the voltage level of the sub-power source line caused by operation of the internal circuit. Therefore, the voltage level of the sub-power source line can be maintained substantially constant during operation of the internal circuit. Thus, the internal circuit can be operated stably.

Seventh Embodiment

Figure 29:
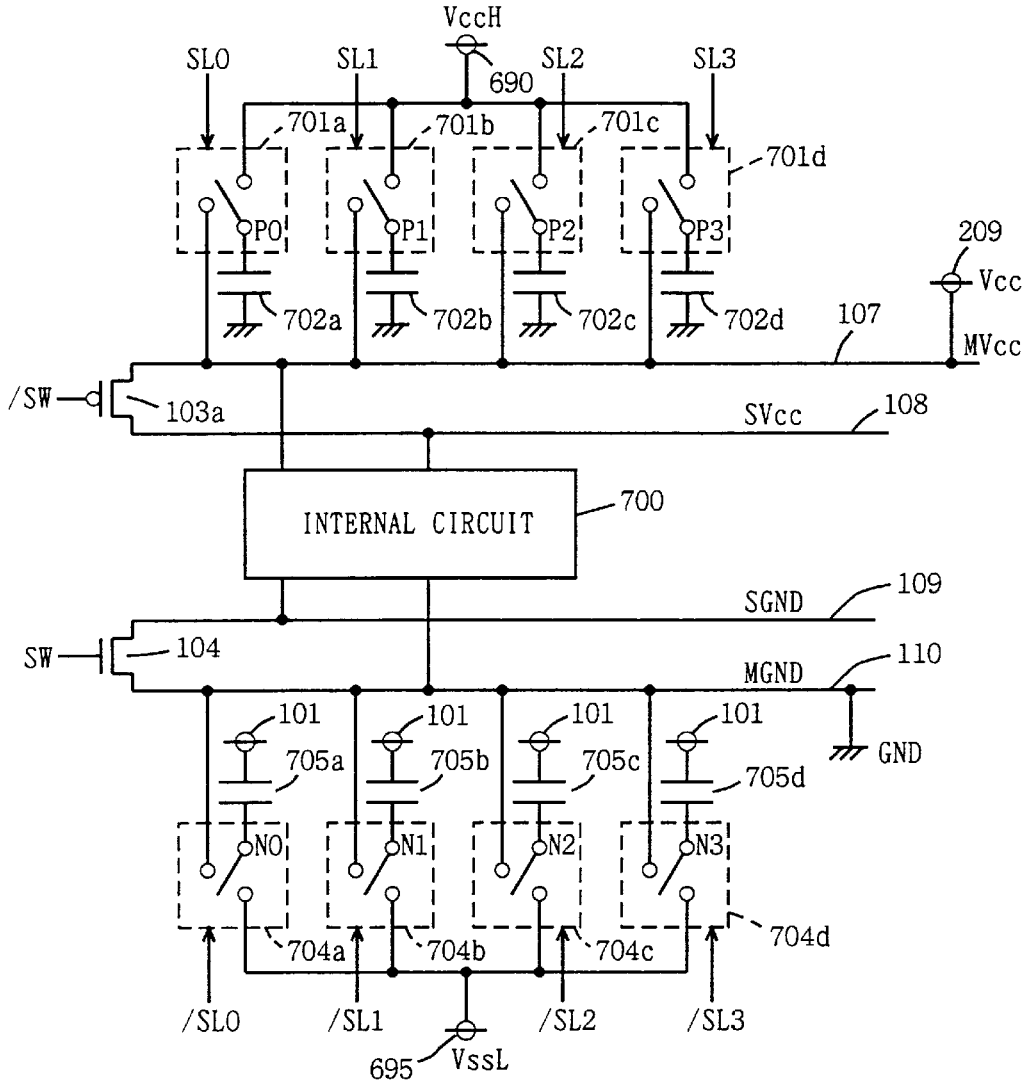
FIG. 29 represents a schematic structure of a semiconductor device according to a seventh embodiment of the present invention.

FIG. 29 schematically shows a structure of a semiconductor device according to a seventh embodiment of the present invention. Referring to FIG. 29, a plurality (four in FIG. 29) of capacitors 702*a*–702*d*, and switch circuits 701*a*–701*d* corresponding to capacitors 702*a*–702*d* are provided main power supply line 107. Switch circuits 701*a*–701*d* respond to select signals SL0–SL3 to connect corresponding capacitors 702*a*–702*d* to a reference power supply node 960 or to main power supply line 107. A voltage VccH higher than voltage Vdd on main power supply line 107 is applied to reference power supply node 690. Voltage VccH on reference power supply node 690 is an external power supply voltage if voltage Vcc on main power supply line 107 is a voltage generated by down-converting the external power supply voltage internally. When external power supply voltage is applied to power supply node 209 of main power supply line 107, voltage VccH applied to reference power supply node 690 becomes a high voltage Vpp obtained by boosting external power supply voltage or internal power supply voltage.

Switching circuits 701*a*–701*d* respectively connect charging electrode nodes P0–P3 of corresponding capacitors 702*a*–702*d* to main power supply line 107 when respective select signals SL0–SL3 are active, and to reference power supply node 690 when corresponding select signals SL0–SL3 are inactive.

Capacitors 705*a*–705*d* and switch circuits 704*a*–704*d* arranged corresponding to these capacitors to connect corresponding capacitors 705*a*–705*d* to main ground line 110 in response to select signals /SL0–/SL3 are provided for main ground line 110.

Switch circuits 704*a*–704*d* connect charging electrode nodes N0–N3 of corresponding capacitors to main ground line 110 when select signals /SL0–/SL3 are active, and to a negative power supply node 695 when corresponding select signals /SL-/SL3 are inactive. A voltage VssL lower than ground voltage GND is applied to negative power supply node 695. Negative voltage VssL is generated within the semiconductor device.

Main power supply line 107 and sub-power supply line 108 are connected via switching transistor 103*a* that responds to control signal /SW. Main ground line 110 and sub-ground line 109 are connected via switching transistor 104 rendered conductive in response to control signal SW.

Figure 30A:
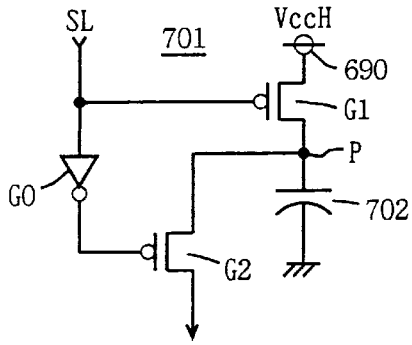
FIGS. 30A and 30B represent a structure of the switching circuit of FIG. 29.

FIG. 30A shows an example of a structure of switch circuits 704*a*–704*d* of FIG. 29. In FIG. 30A, the structure of switch circuit 701 is shown as a representative of switch circuits 701*a*–701*d*. Referring to FIG. 30A, switch circuit 701 includes a p channel MOS transistor G1 rendered conductive in response to a select signal SL (SL0–SL3) of an L level to electrically connect a charging electrode node P of capacitor 702 to reference power supply node 690, an inverter G0 for inverting select signal SL, and a p channel MOS transistor G2 rendered conductive in response to an L level output signal of inverter G0 to electrically connect charging electrode node P of capacitor 702 to main ground line 107. In switch circuit 701, MOS transistors G1 and G2 attain a conductive/non-conductive state complementarily. Capacitor 702 is disconnected from the main power supply line when charging electrode node P is connected to reference power supply node 690 and disconnected from reference power supply node 690 when charging electrode node P is connected to the main power supply line.

Figure 30B:
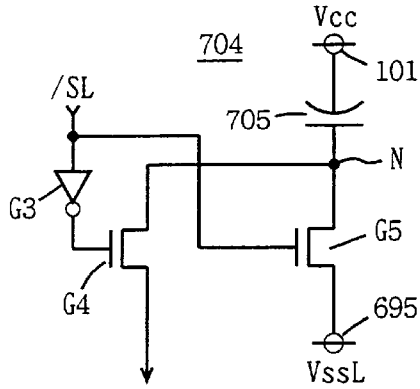

FIG. 30B shows a structure of switch circuits 704*a*–704*c* of FIG. 29. In FIG. 30B, switch circuit 704 is shown as a representative of switch circuits 704*a*–704*d*.

Referring to FIG. 30B, switch circuit 704 includes an inverter G3 for inverting select signal /SL, an n channel MOS transistor G4 rendered conductive in response to an output signal of inverter G3 when select signal /SL is at an L level to connect charging electrode node N of capacitor 705 to the main ground line, and an n channel MOS transistor G5 rendered conductive when select signal /SL attains an H level to electrically connect charging electrode node N of capacitor 705 to negative power supply node 695. According to the structure of switch circuit 704 of FIG. 30B, charging electrode node N of capacitor 705 is selectively connected to negative power supply node 695 or to the main ground line by MOS transistors G4 and G5.

In the structures shown in FIGS. 30A and 30B, inverters G0 and G3 have a level converting function. The H level of select signal SL corresponds to the level of high voltage VccH, and the L level of select signal /SL corresponds to the level of negative voltage VssL.

According to the structure of FIG. 29 in which main power supply line 107 is electrically connected to sub-power supply line 108 and main ground line 110 is electrically connected to sub-ground line 109, capacitors 702*a*–702*d* are selectively connected to main power supply line 107 in the operating state of internal circuit 700 to raise the level of voltage Vcc on main power supply line 107. At the same time, capacitors 705*a*–705*d* are selectively connected to main ground line 110 to reduce the voltage level on main ground line 110, whereby the level of voltage SGND on sub-ground line 109 is reduced. The operation of the semiconductor device of FIGS. 29, 30A, and 30B will be described with reference to the signal waveform diagram of FIG. 31.

Figure 31:
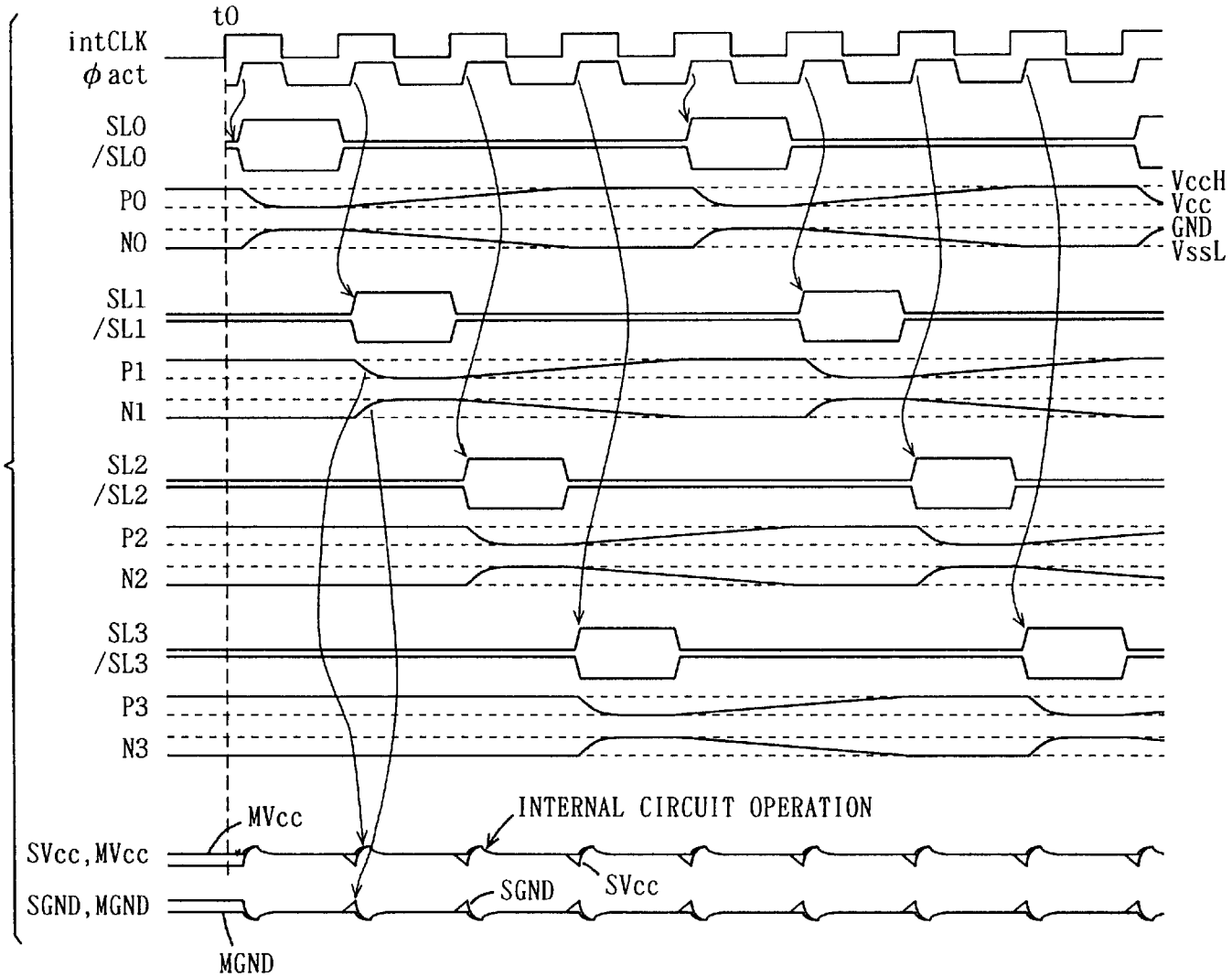
FIGS. 31 and 32 are signal waveform diagrams representing an operation of the semiconductor device of FIG. 29.

In the signal waveform diagram of FIG. 31, internal circuit 700 operates in synchronization with internal clock signal intCLK. Signal ϕact for activating internal circuit 700 is driven to an active state for a predetermined period in each clock cycle.

Prior to time t0, switching transistors 103*a* and 104 are at a non-conductive state. Voltage SVcc on sub-power supply line 108 is lower than the level of voltage MVcc (Vcc) on main power supply line 107. Voltage SGND on sub-ground line 109 is higher in level than voltage MGND (GND) on main ground line 110.

Under this state, select signals SL0–SL3 all are in an inactive state of an L level. Switch circuits 701*a*–701*d* connect corresponding capacitors 702*a*–702*d* to reference power supply node 690. Therefore, charging electrode nodes P0–P3 of capacitors 702*a*–702*d* are charged to the level of high voltage VccH. Select signals /SL0–/SL3 all are at an H level. Switch circuits 704*a*–704*d* connect respective capacitors 705*a*–705*d* to negative power supply node 695. Therefore, charging electrode nodes N0–N3 of capacitors 705*a*–705*d* are charged to the level of negative voltage VssL.

When an internal circuit activation signal (or a command that activates the internal circuit) is applied at time t0, activation signal ϕact attains an active state of an H level for a predetermined time. In response to activation of signal ϕact, select signals SL0 and /SL0 are activated. Switch circuit 701*a* connects charging electrode node P0 of capacitor 702*a* to main power supply line 107. Switch circuit 704*a* connects charging electrode node N0 of capacitor 705*a* to main ground line 110. At this stage, control signals SW and /SW are activated, and responsively switching transistors 103*a* and 104 conduct. Main power supply line 107 is electrically connected to sub-power supply line 108, and sub-ground line 109 is electrically connected to main ground line 110.

Capacitor 702*a* supplies the charges to main power supply line 107 so that the level of the charging node voltage is reduced. In contrast, the voltage levels of main power supply line 107 and sub-power supply line 108 increase. The voltage on main ground line 110 is reduced by the negative charges supplied from capacitor 704*a*. Also, the level of voltage SGND on sub-ground line 109 is reduced.

In this state, internal circuit 700 operates to consume current. The voltage on main power supply line 107 is already made higher than the normal level of power supply voltage Vcc, and voltage MGND on main ground line 110 is made lower than ground voltage GND. Since the charges supplied from capacitors 702*a* and 705*a* are consumed during operation of internal circuit 700, reduction in voltages MVcc and SVcc on main power supply line 107 and sub-power supply line 108 can be suppressed. Also, increase in voltages MGND and SGND on main ground line 110 and sub-ground line 109 can be suppressed. Therefore, internal circuit 700 can operate stably. In a steady state, the voltages of main power supply line 107 and sub-power supply line 108 substantially attain the level of power supply voltage Vcc, while voltages on main ground line 110 and sub-ground line 109 attain the level of ground voltage GND.

At the expiration of one clock cycle, select signals SL0 and /SL0 are rendered inactive. Switch circuit 701*a* connects capacitor 702*a* to reference power supply node 690. Switch circuit 704*a* connects capacitor 705*a* to negative power supply node 695. As a result, the level of the charging voltage of capacitors 702*a* and 705*a* is recovered.

When an activation signal is applied again at the next clock cycle, select signals SL1 and /SL1 are activated in response to this activation signal ϕact. Capacitors 702*b* and 705*b* are electrically connected to main power supply line 107 and main ground line 110 by switch circuits 701*b* and 704*b*, respectively. At the same time, control signals SW and /SW are also activated, and electrical connection of main power supply line 107 and sub-power supply line 108 and electrical connection of sub-ground line 109 and main ground line 110 are made. As a result, voltage SVcc on sub-power supply line 108 which was reduced by inactivation of control signals SW and /SW rises whereas voltage SGND on sub-ground line 109 which was raised is reduced. Although internal circuit 700 operates again to consume current in this state, reduction of the voltage on main power supply line 107 and sub-power supply line 108 to a level lower than the predetermined level and increase of the voltage on main ground line 110 and sub-ground line 109 to a level higher than a predetermined level can be suppressed.

Select signals SL2, /Sl2 and SL3, /SL3 are sequentially rendered active in response to the signal that activates the internal circuit at each clock cycle.

By making the voltage on the power source line greater in absolute value at initiation of an operation of internal circuit 700, reduction of the power supply voltage and increase of the ground voltage can be suppressed even when the current is consumed during operation of internal circuit 700. Therefore, internal circuit 700 can operate stably. Capacitors 702*a*–702*d* must raise the voltage level on main power supply line 107, whereas capacitors 705*a*–705*d* must lower the voltage on main ground line 110. Therefore, their capacitances are made relatively greater. By sequentially utilizing the capacitive elements in an interleaving manner, capacitive elements 702*a*–702*d* and 705*a*–705*d* can be charged to a predetermined voltage level reliably even when a long period of time is required for the charging. Thus, the voltage level on the main power supply line and the voltage level on the main ground line can be reliably increased and decreased, respectively, in a high speed operation.

Control signal SW is generated by an ORing of select signals SL0–SL3, and control signal /SW is generated by an NORing of select signals SL0–SL3.

By connecting main power supply line 107 and main ground line 110 to a capacitive element, variation in the operating power source voltages can be suppressed even for a circuit that uses the voltage on the sub-power supply line and the sub-ground line as well as a circuit that utilizes the voltage on the main power supply line and the main ground line in an internal circuit. Internal circuit 700 can be operated stably regardless of the operating power sources of the logic circuit in internal circuit 700.

[Modification]

Figure 32:
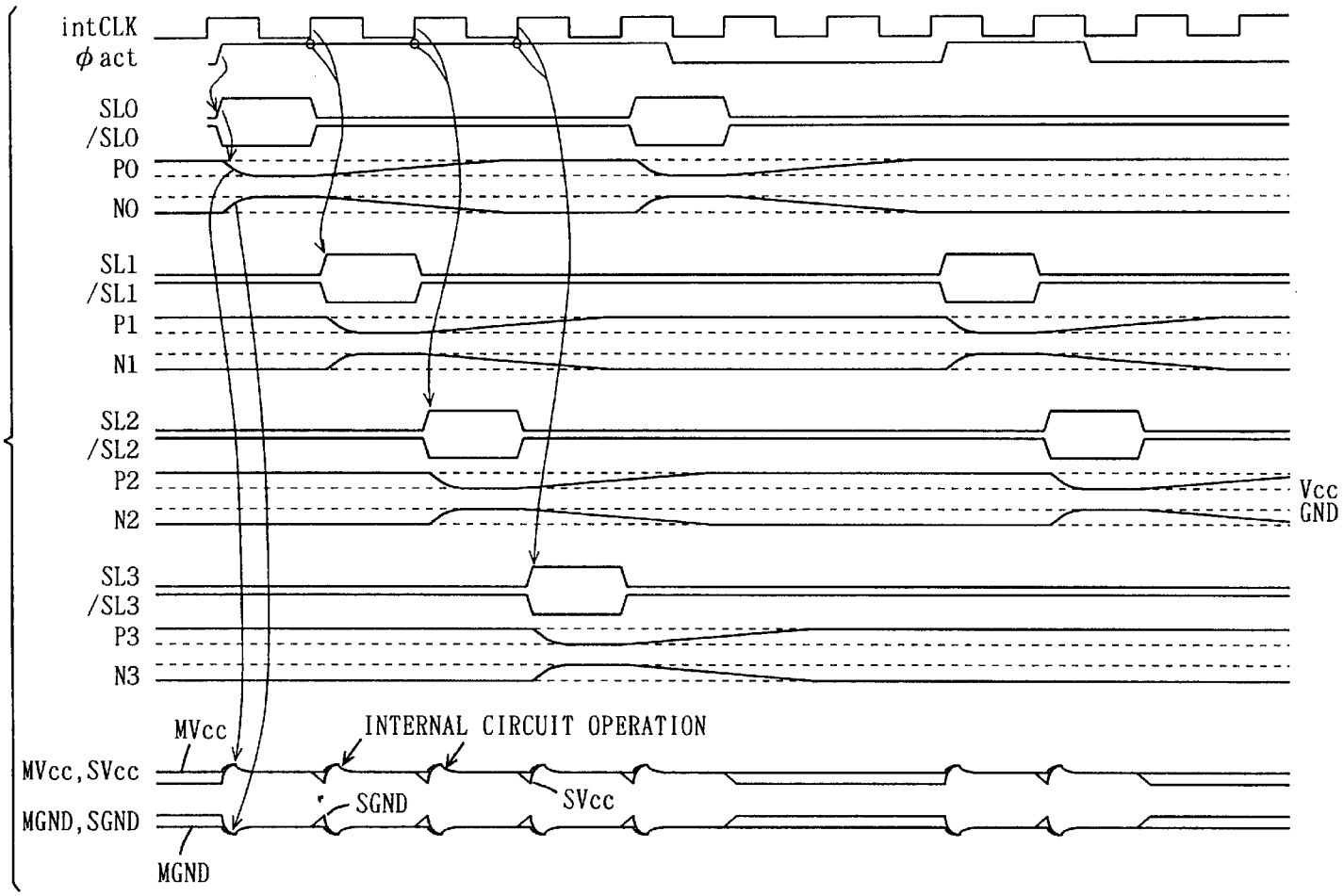

FIG. 32 shows a modification of the operation sequence of the semiconductor device of FIG. 29. In the signal waveform diagram of FIG. 32, internal circuit activation signal ϕact is maintained active over a plurality of clock cycles. During this activation period of internal circuit activation signal ϕact, select signals SL0, /SL0–SL3, /SL3 are sequentially driven to an active state in each clock cycle. Control signals SW and /SW respond to activation of these select signals to be active during the activation period. In response to activation of select signals SL0, /SL0–SL3, /SL3, charges are supplied to the main and sub-power supply lines and to the main and subground lines. During the activation period of internal circuit activation signal ϕact, a sub-circuit in the internal circuit is operated in each clock cycle. For example, when a read command designating data reading is applied in a clock synchronous type memory, a read circuit activation signal for activating a circuit group related to data reading is activated for a predetermined time period (normally, the burst length period). During this activation period, a column select operation is carried out internally to read out data from a selected memory cell and effect internal transfer for outputting data every clock cycle. In this case, the internal circuit operates in each clock cycle in the read related circuitry. Therefore, the internal circuit operates in synchronization with the clock signal in each clock cycle even when the internal circuit activation signal is in an active state over a plurality of clock cycles. By driving the select signals sequentially to an active state for each clock cycle, charges can be supplied to the main power supply line and the main ground line according to the operation of the internal circuit, to prevent reduction in the effective voltage caused by operation of the internal circuit.

In the case of a portable terminal and the like, a data packet is transmitted/received and a decoding/coding operation is carried out internally in synchronization with a clock signal when a communication mode is activated. By supplying charges from the capacitor to the main power supply line and the main ground line in each clock cycle, the internal circuit can operate stably since the internal circuit operates in synchronization with the clock signal during the activation period of the communication mode.

According to the operation waveform diagram of FIG. 32, the main power supply line and the sub-power supply line are disconnected when select signals SL0, /SL0–SL3, /SL3 are inactive so that the voltage level on the sub-power supply line is reduced. Also, the main ground line and the sub-ground line are disconnected so that the voltage level on the sub-ground line rises. However, control signals SW and /SW may be driven active continuously during activation of internal circuit activation signal ϕact, whereby the main ground line and the sub-ground line and also the sub-power supply line and the main power supply line are connected together, respectively.

The operation waveform diagram of FIGS. 31 and 32 show the reduction in voltage of the charging electrode node of the capacitor down to the level of power supply voltage Vcc when the capacitor is connected to the main power supply line. This is realized by equalizing the current consumption of the internal circuit with the charges supplied by the capacitive element. The same applies to the case where the voltage level of electrode nodes (N0–N3) of the capacitor connected to the main ground line rises to the level of ground voltage GND.

Figure 33:
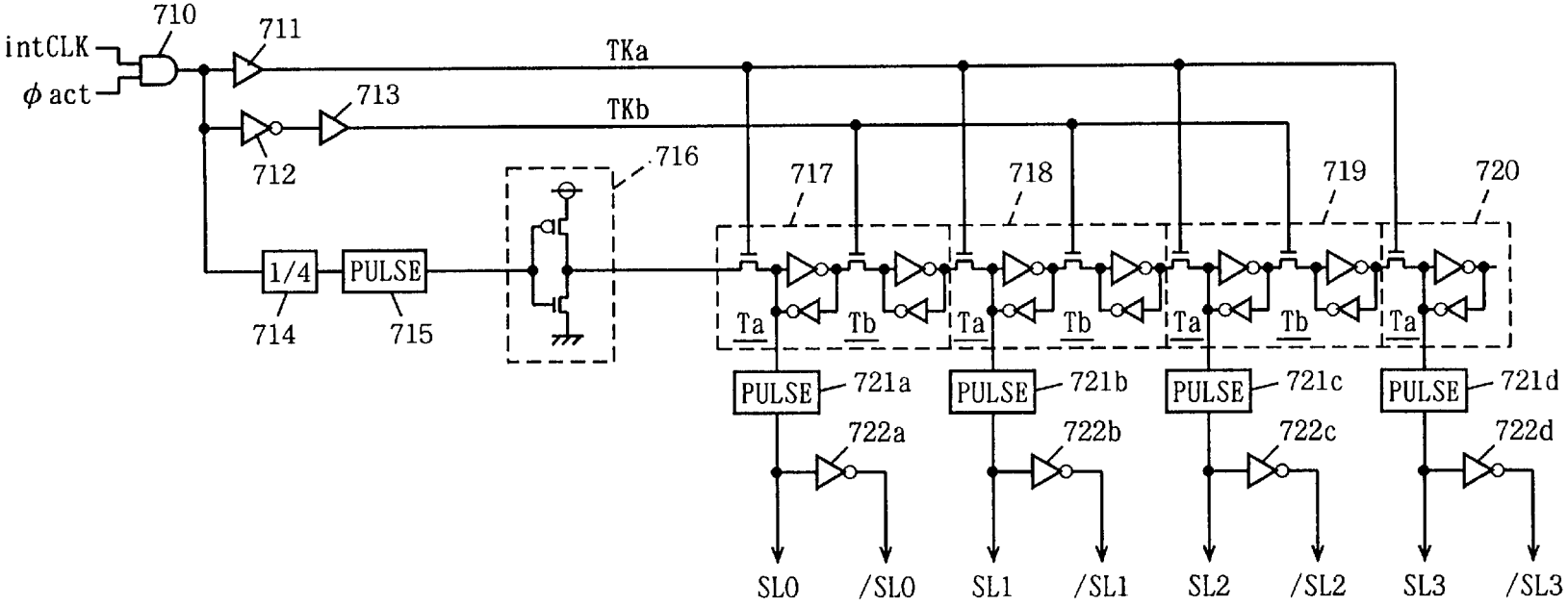
FIG. 33 represents a structure of a select signal generation circuit of the semiconductor device of FIG. 29.

FIG. 33 shows a structure of a select signal generation circuit. Referring to FIG. 33, the select signal generation circuit includes an AND circuit 710 receiving internal clock signal intCLK and activation signal ϕact, a driver 711 applying a buffer process on an output signal of AND circuit 710 to generate a transfer clock signal TKa with great drivability, an inverter circuit 712 for inverting an output signal of AND circuit 710, a driver 713 buffering an output signal of inverter circuit 712 to generate a transfer clock signal TKb with a great drivability, a ¼ frequency divider 714 for frequency-dividing the output signal of AND circuit 710 by a factor of 4, a pulse generation circuit 715 for generating a one shot pulse signal in response to a rise (or a fall) of the output signal of ¼ frequency divider 714, and an inverter circuit 716 for inverting the output signal of pulse generation circuit 715. When internal circuit activation signal ϕact is at an H level of an active state, a clock signal in synchronization with internal clock signal intCLK is output from AND circuit 710. Complementary transfer clock signals are generated from drivers 711 and 713. Inverter circuit 716 is provided to match the logic and to drive the shift register circuit of the next stage at high speed.

The select signal generation circuit further includes three stages of shift registers 717, 718 and 719 for transferring the output signal of inverter circuit 716, a register 720 for receiving and latching the output signal of shift register 719 in synchronization with a clock signal from driver 711, pulse generation circuits 721*a*–721*d* provided corresponding to the input nodes of shift registers 717–719 and register 720 and each generating a one shot pulse signal in response to a signal change in a corresponding input node, and inverters 722*a*–722*d* for inverting the output signals of pulse generation circuits 721*a*–721*d*, respectively.

Figure 34:
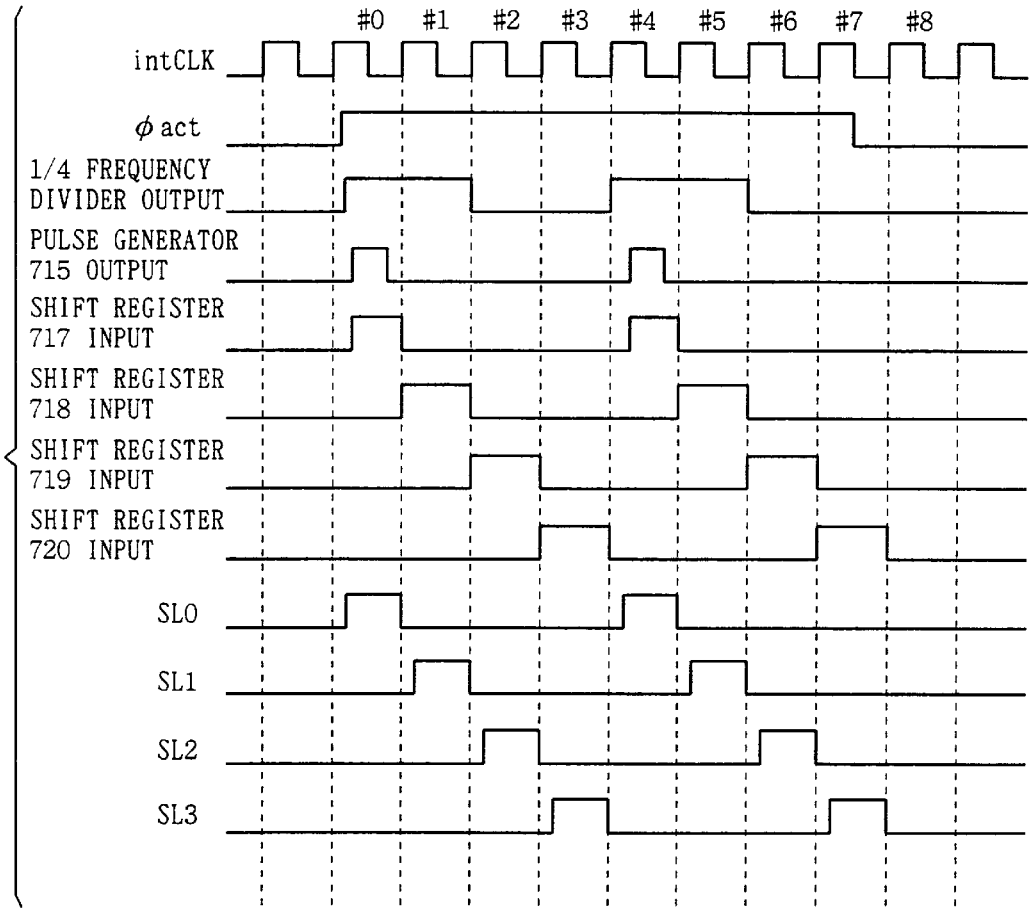
FIG. 34 is a timing chart representing an operation of the circuit of FIG. 33.

Select signals SL0–SL3 are output from pulse generation circuits 721*a*–721*d*. Complementary select signals /SL0–/SL3 are output from inverter circuits 722*a*–722*d*, respectively. The operation of the select signal generation circuit of FIG. 33 will now be described with reference to the timing chart of FIG. 34.

Internal clock signal intCLK is generated constantly independent of the operation of the internal circuit. At clock cycle #0, an internal circuit activation designating signal (or activation command) is applied, whereby internal circuit activation signal ϕact is driven to an active state of an H level. In response, a clock signal in synchronization with internal clock signal intCLK is output from AND circuit 710. ¼ frequency divider circuit 714 frequency-divides the clock signal from AND circuit 710 by a factor of 4. Pulse generation circuit 714 responds to a rise of the output signal of ¼ frequency divider circuit 714 to generate a one shot pulse signal. This one shot pulse signal is applied to shift register 717 via inverter circuit 716. Drivers 711 and 713 generate transfer clock signals TKa and TKb in synchronization with internal clock signal intCLK when activation signal ϕact is active.

At clock cycle #0, shift register 717 takes in and latches a received pulse at transfer latch Ta of the first stage when transfer clock signal TKa output from driver 711 is at an H level, and then enters a latch state when transfer clock signal TKa output from driver 711 is pulled down to an L level. Then, transfer clock signal TKb output from driver 713 attains an H level, and the pulse latched at transfer latch Ta is transferred and latched at the next stage of transfer latch Tb. Pulse generation circuit 721*a* generates a one shot pulse signal in response to a rise of the latch signal of transfer latch Ta of shift register 717, and therefore select signal SL0 having a predetermined pulse width is driven to an active state.

At clock cycle #1, the signal of an H level latched at shift register 717 is transferred to and latched at the first stage of transfer latch Ta of the next stage of shift register 718 in synchronization with transfer clock signals TKa and TKb from drivers 711 and 713, respectively. Therefore, at clock cycle #1, pulse generation circuit 721*b* generates a one shot pulse signal having a predetermined time width to render select signal SL1 active. When transfer clock signal TKb output from driver 713 attains an H level at clock cycle #1, the signal in transfer latch Ta is transferred to transfer latch Tb in shift register 718.

At clock cycle #2, the signal latched at transfer latch Tb in shift register 718 is transferred to shift register 719, and the signal at the input node of the first stage of transfer latch Ta rises to an H level. In response, pulse generation circuit 721*c* generates a one shot pulse signal to drive select signal SL2 to an active state.

At clock cycle #3, the signal is transferred from shift register 719 to register 720 in synchronization with a rise of transfer clock signal TKa from driver 711. The signal latched in register 720 is pulled up to an H level. Responsively, pulse generation circuit 721*d* generates a one shot pulse signal, and select signal SL3 is driven to an active state for a predetermined time.

At clock cycle #4, the output signal of ¼ frequency divider circuit 714 rises to an H level again. In response, pulse generation circuit 715 generates a one shot pulse signal. An operation similar to that from clock cycle #0 to clock cycle #3 is repeatedly carried out thereafter, and select signals SL0–SL3 are sequentially driven to an active state at different clock cycles.

At clock cycle #7, internal circuit activation signal ϕact is driven to an inactive state in response to an internal circuit inactivation designation. In this clock cycle #7, the output signal of AND circuit 710 is pulled up in synchronization with internal clock signal intCLK. In response, transfer clock signals TKa and TKb are generated from drivers 711 and 713, respectively. Therefore, select signal SL3 is made active in this clock cycle #7, whereby charges are supplied from the capacitor to the main power supply line and main ground line. When the internal circuit shifts to a reset state in response to internal circuit activation signal ϕact being inactive, the current consumed by the circuit operation during this transition to the reset state can be compensated for by the charges from the capacitor. Therefore, the internal circuit can be reliably be reset to a predetermined state.

With a clock synchronous type DRAM, internal circuit activation signal ϕact can be a signal that is activated by an externally applied active command and inactivated by a precharge command. Alternatively, it may be a signal that maintains an active state over a plurality of clock cycles, such as a read/write related circuit activation signal that is rendered active when a read/write command is applied.

Figure 35:
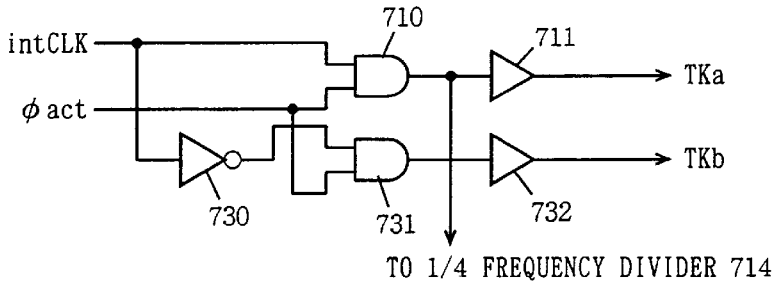
FIG. 35 represents a structure of a modification of the select signal generation circuit of FIG. 33.
Figure 36:
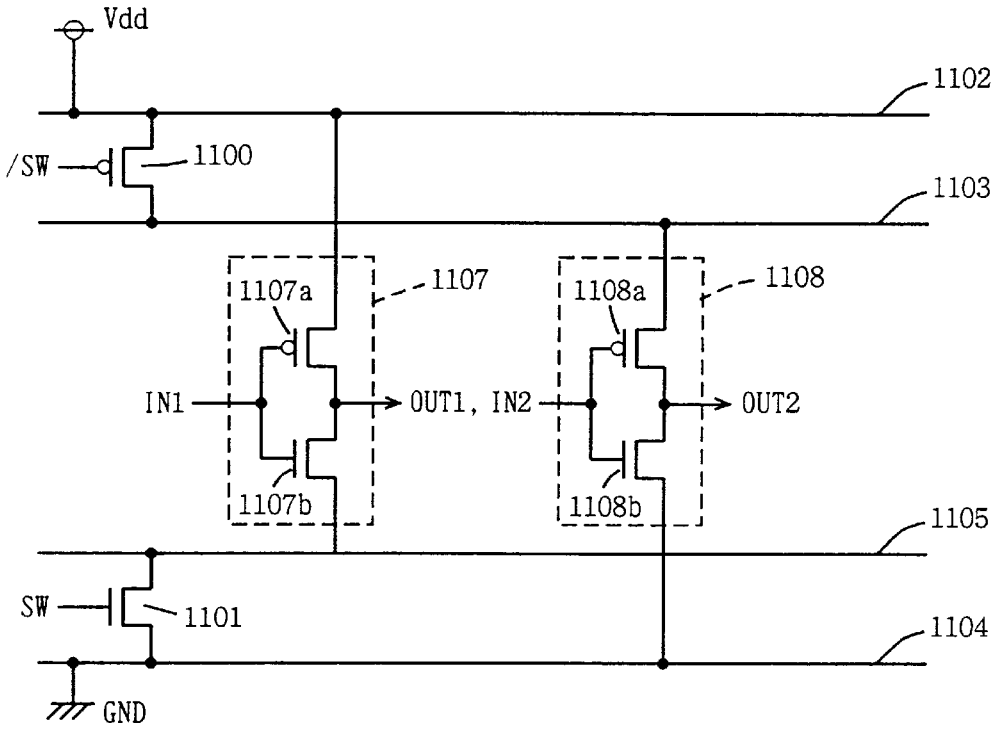
FIG. 36 PRIOR ART
FIG. 36 represents a structure of a semiconductor device of a conventional hierarchical power supply structure.
Figure 37:
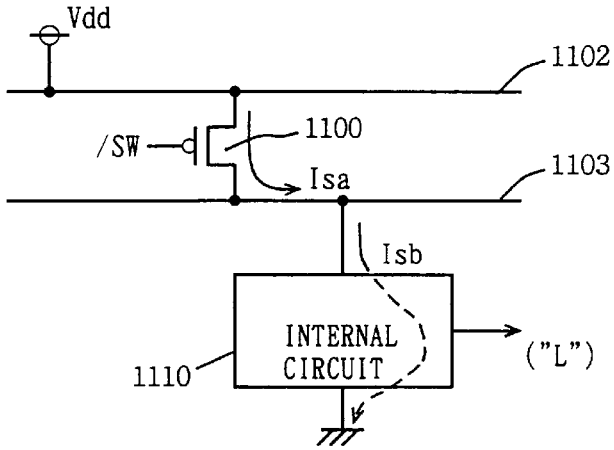
FIG. 37 PRIOR ART
FIG. 37 is a diagram for explaining an operation of a conventional semiconductor device.

FIG. 35 shows a modification of the select signal generation circuit. In FIG. 35, the portion related to generation of transfer clock signals TKa and TKb is shown. The structure of the portion generating a select signal is identical to that shown in FIG. 33.

Referring to FIG. 35, the select signal generation circuit includes an AND circuit 710 receiving internal clock signal intCLK and internal circuit activation signal ϕact, a driver 711 for generating transfer clock signal TKa according to an output signal of AND circuit 710, an inverter circuit 730 for inverting internal clock signal intCLK, an AND circuit 731 receiving the output signal of inverter circuit 730 and internal circuit activation signal ϕact, and a driver 732 for generating transfer clock signal TKb according to an output signal of AND circuit 731. When internal circuit activation signal ϕact is active, clock signals complementary to each other are generated from AND circuits 710 and 731. Therefore, transfer clock signals TKa and TKb are clock signals complementary to each other. Thus, the operation shown in FIG. 34 can be realized.

According to the circuit structure shown in FIG. 35, the propagation delay from AND circuits 710 and 731 up to generation of transfer clock signals TKa and TKb can be made identical, to reliably prevent both transfer clock signals TKa and TKb from attaining an H level at the same time.

According to the structure of FIG. 31 in which the select signal is sequentially switched in response to activation of internal circuit activation signal ϕact, an internal circuit activation signal can be used as a transfer clock signal for the shift registers connected in a ring-like manner.

According to the above structure, a capacitor is connected to the node receiving a voltage greater in absolute value than the voltage on the main power source line, and then connected to the main power source line in the operation of the internal circuit. What is required is that the current consumed by the internal circuit can be compensated for by the charges supplied from the capacitor. Therefore, the capacitive element (capacitor) can be configured to receive a voltage identical in absolute value to the voltage transmitted on the main power source line.

The number of capacitors is selected appropriately according to the time required for charging each capacitor.

In addition, a structure can be provided for the sub-power source line, in which the capacitive element is connected to the sub-power source line in an operating mode of the internal circuit.

According to the present invention, the internal circuit can be operated stably and speedily since voltage variation in the sub-power source line is suppressed in the operation of the internal circuit.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A semiconductor device comprising:

a main power source line for transmitting a voltage of a predetermined level;

a sub-power source line;

a reference power supply node for supplying a voltage greater in an absolute value than said voltage of the predetermined level transmitted on said main power source line;

an internal circuit operating using a voltage on said sub-power source line as one operating power source voltage; and a switch circuit responsive to an operation initiation designating signal for said internal circuit, for forming a current flowing path between said reference power supply node and said sub-power source line.

2. The semiconductor device according to claim 1, wherein said switch circuit comprises a first switching element rendered conductive in response to said operation initiation designating signal, to electrically connect said main power source line to said sub-power source line, and a second switching element rendered conductive for a predetermined period in response to said operation initiation designating signal, to electrically connect said reference power supply node to said sub-power source line.

3. The semiconductor device according to claim 1, wherein said switch circuit comprises a first switching element rendered conductive in response to said operation initiation designating signal, to transmit the voltage on said main power source line, a second switching element rendered conductive for a predetermined period in response to said operation initiation designating signal, to transmit the voltage of said reference power supply node, and a third switching element coupled between said first and second switching elements and said sub-power source line, and rendered conductive in response to said operation initiation designating signal, to electrically connect the first and second switching elements to said sub-power source line.

4. The semiconductor device according to claim 1, wherein said switch circuit comprises comparison circuitry activated in response to said operation initiation designating signal, to compare the voltage on said sub-power source line with a reference voltage, and a switching element coupled between said reference power supply node and said sub-power source line to cause a current flow between said reference power supply node and said sub-power source line in response to an output signal of said comparison circuitry.

5. A semiconductor device comprising:

a main power source line for transmitting a voltage of a predetermined level;

a sub-power source line;

a internal circuit operating using a voltage on said sub-power source line as one operating power supply voltage;

a switching element rendered conductive in response to an operation initiation designating signal for said internal circuit, to electrically connect said main power source line with said sub-power source line; and a capacitive element responsive to said operation initiation designating signal for supplying charges to said sub-power source line.

6. The semiconductor device according to claim 5, wherein said capacitive element performs a charge pumping operation in response to said operation initiation designating signal to transmit charges to said sub-power source line.

7. The semiconductor device according to claim 5, further comprising circuitry responsive to said operation initiation designating signal for applying to said capacitive element a signal having an amplitude of an intermediate voltage between the voltage on said main power source line and a voltage differing in logic from said voltage on said main power source line.

8. The semiconductor device according to claim 5, wherein said capacitive element comprises first and second capacitors responsive to said operation initiation designating signal for supplying charges to said sub-power source line in a complementary manner.

9. The semiconductor device according to claim 8, further comprising a drive circuit responsive to said operation initiation designating signal for generating complementary drive signals in synchronization with an externally and repeatedly applied clock signal and applying said complementary drive signals to said first and second capacitors respectively.

10. The semiconductor device according to claim 8, further comprising circuitry responsive to said operation initiation designating signal for connecting said first and second capacitors to said sub-power source line complementarily.

11. The semiconductor device according to claim 10, further comprising circuitry responsive to said operation initiation designating signal for charging output nodes of said first and second capacitors when said first and second capacitors are disconnected from said sub-power source line.

12. A semiconductor device comprising:

a first main power source line for transmitting a first predetermined voltage;

a second main power source line for transmitting a second predetermined voltage differing in logic from said first predetermined voltage;

a first sub-power source line;

a second sub-power source line;

an internal circuit operating using voltages on said first main power source line and said second sub-power source line as both operating power supply voltages;

a first switching element responsive to an operation initiation designating signal for said internal circuit, for connecting said first main power source line to said first sub-power source line;

a second switching element responsive to said operation initiation designating signal for connecting said second main power source line to said second sub-power source line;

a reference power supply node for supplying a voltage greater in absolute value than said first predetermined voltage; and compensation circuitry coupled to said second sub-power source line and to said reference power supply node and responsive to a voltage change in said second sub-power source line for changing the voltage on said first main power source line in a direction identical to a direction of the voltage change in said second sub-power source line.

13. The semiconductor device according to claim 12, wherein said compensation circuitry comprises a circuit for generating a reference voltage depending upon the voltage on said second sub-power source line, a comparison circuit for comparing the voltage on said first main power source line with said reference voltage, and a drive element coupled between said reference power supply node and said first main power source line, and responsive to an output signal of said comparison circuit for causing a current flow between said first main power source line and said reference power supply node.

14. The semiconductor device according to claim 12, wherein said compensation circuitry comprises a voltage dividing circuit for dividing the voltages on the first and second main power source lines, said voltage divider circuit including a variable resistance element having a resistance value varied according to a difference between the voltages of said second main power source line and said second sub-power source line, a comparison circuit for comparing an output voltage of said voltage dividing circuit and a reference voltage, and a drive element responsive to an output signal of said comparison circuit for causing a current flow between said reference power supply node and said first main power source line.

15. The semiconductor device according to claim 14, wherein said voltage dividing circuit comprises a resistance element connected to said first main power source line, a comparator for comparing the voltage on said second main power source line and the voltage on said second sub-power source line, and a variable conductance element connected between said resistance element and said second main power source line, and having a conductance varied according to an output signal of said comparator.

16. The semiconductor device according to claim 12, wherein said compensation circuitry comprises a circuit for causing a current flow between said reference power supply node and said first main power source line in accordance with a difference between a voltage on said first sub-power source line and a reference voltage.

17. The semiconductor device according to claim 12, further comprising:

a second internal circuit operating using the voltage on one of the first and second main power source lines as one operating power supply voltage; and control circuitry responsive to said operation initiation designating signal for coupling a capacitive element to the one main power source line, said capacitive element being charged to a prescribed voltage level.

18. The semiconductor device according to claim 17, wherein said capacitive element is charged to a voltage greater in absolute value than the voltage on said one main power source line.

19. The semiconductor device according to claim 17, wherein said capacitive element includes a plurality of capacitors connected in parallel, wherein said control circuitry sequentially connects said plurality of capacitors to said one main power source line in a predetermined sequence in response to said operation initiation designating signal.

20. The semiconductor device according to claim 19, wherein said control circuitry comprises a circuit for charging each capacitor to said prescribed voltage level when the capacitor is disconnected from said one main power source line.

* * * * *